US010322595B2

(12) United States Patent
Dentani et al.

(10) Patent No.: US 10,322,595 B2
(45) Date of Patent: Jun. 18, 2019

(54) SUBLIMATION-TYPE INKJET TEXTILE PRINTING TRANSFER PAPER AND METHOD FOR PRODUCING SAME

(71) Applicant: DAIO PAPER CORPORATION, Shikokuchuo-shi, Ehime (JP)

(72) Inventors: Yoshinobu Dentani, Kani (JP); Yuta Kirihara, Kani (JP)

(73) Assignee: DAIO PAPER CORPORATION, Shikokuchuo-shi, Ehime (JP)

( * ) Notice: Subject to any disclaimer, the term of this patent is extended or adjusted under 35 U.S.C. 154(b) by 29 days.

(21) Appl. No.: 15/552,708

(22) PCT Filed: Jan. 12, 2016

(86) PCT No.: PCT/JP2016/000121
§ 371 (c)(1),
(2) Date: Aug. 22, 2017

(87) PCT Pub. No.: WO2016/136122
PCT Pub. Date: Sep. 1, 2016

(65) Prior Publication Data

US 2018/0264864 A1 Sep. 20, 2018

(30) Foreign Application Priority Data

Feb. 27, 2015 (JP) ..... 2015-039058
Aug. 10, 2015 (JP) ..... 2015-158204
Sep. 11, 2015 (JP) ..... 2015-179885

(51) Int. Cl.

| | |
|---|---|
| ***B41M 5/52*** | (2006.01) |
| ***D21H 27/00*** | (2006.01) |
| ***D21H 19/38*** | (2006.01) |
| ***D21H 19/52*** | (2006.01) |
| ***D21H 19/82*** | (2006.01) |
| ***B41M 5/50*** | (2006.01) |
| ***B44C 1/17*** | (2006.01) |
| ***D06P 5/28*** | (2006.01) |
| ***D21H 19/40*** | (2006.01) |
| ***D21H 21/52*** | (2006.01) |

(52) U.S. Cl.
CPC ..... *B41M 5/5236* (2013.01); *B41M 5/508* (2013.01); *B41M 5/52* (2013.01); *B44C 1/1712* (2013.01); *D06P 5/004* (2013.01); *D21H 19/38* (2013.01); *D21H 19/40* (2013.01); *D21H 19/52* (2013.01); *D21H 19/82* (2013.01); *D21H 19/828* (2013.01); *D21H 21/52* (2013.01); *D21H 27/00* (2013.01); *B41M 5/5218* (2013.01)

(58) Field of Classification Search
CPC ..... B41M 5/50; B41M 5/52; B41M 5/5218; B41M 2205/02; B41M 2205/10; B41M 2205/32
USPC ..... 503/227
See application file for complete search history.

(56) References Cited

U.S. PATENT DOCUMENTS

| | | | |
|---|---|---|---|
| 6,214,417 | B1 | 4/2001 | Watanabe et al. |
| 6,902,779 | B1 | 6/2005 | de Visser et al. |

FOREIGN PATENT DOCUMENTS

| | | |
|---|---|---|
| JP | H11-081163 | 3/1999 |
| JP | 2002-521245 | 7/2002 |
| JP | 2002-292995 | 10/2002 |
| JP | 2003-276309 | 9/2003 |
| JP | 2003-313786 | 11/2003 |
| JP | 2010-037697 | 2/2010 |
| JP | 2010-089343 | 4/2010 |
| JP | 2010-110973 | 5/2010 |
| JP | 2016-159483 | 9/2016 |

OTHER PUBLICATIONS

International Search Report for corresponding International Application No. PCT/JP2016/000121 dated Mar. 8, 2016.
Form PCT/ISA/237 for corresponding International Application No. PCT/JP2016/000121 dated Mar. 8, 2016.

*Primary Examiner* — Gerard Higgins
(74) *Attorney, Agent, or Firm* — Renner Otto Boisselle & Sklar, LLP

(57) ABSTRACT

Sublimation-type inkjet textile printing transfer paper includes a base material and a sublimation-type textile printing ink receiving layer formed on the base material, the base material has a 10-second Cobb water absorption of 5 to 20 g/m$^2$, the sublimation-type textile printing ink receiving layer is made from an ink receiving layer coating material containing a water soluble resin and fine particles, the water soluble resin is at least a CMC, and the CMC is contained in the ink receiving layer coating material in an amount of 100 to 400 parts by mass with respect to 100 parts by mass of the fine particles, the fine particles are at least inorganic fine particles having a tabular crystal structure, the inorganic fine particles have a median diameter d50 of 0.4 to 2.3 μm and an aspect ratio of 5 to 30, a coating amount of the ink receiving layer coating material is 3 to 13 g/m$^2$, and an average of numbers of pinhole appearance is not greater than 5.

9 Claims, No Drawings

SUBLIMATION-TYPE INKJET TEXTILE PRINTING TRANSFER PAPER AND METHOD FOR PRODUCING SAME

TECHNICAL FIELD

The present disclosure relates to sublimation-type inkjet textile printing transfer paper and a method for producing the same. More specifically, the present disclosure relates to sublimation-type inkjet textile printing transfer paper to be used when printing is performed by an inkjet recording method using sublimation-type textile printing ink in a sublimation-type textile printing transfer method for transferring a printed image onto a fabric, and a method for producing the same.

BACKGROUND ART

Transfer printing methods include: a melting type transfer printing method in which ink including wax, a thermosoftening binder such as resin and a pigment is used; a rubber print type transfer printing method in which plastisol ink including powder of polyvinyl chloride or the like, a plasticizer, and a pigment is used; and a sublimation-type textile printing transfer method in which a thermally subliming dye is used.

Conventionally, various printing plates and printing machines designed for the printing plates have been required for forming transfer printing sheets. In recent years, transfer printing sheets for an inkjet recording method suited to a small lot have been proposed, so that the demand for a sublimation-type textile printing transfer method suited to a small lot has been increasing.

The sublimation-type textile printing transfer method is a method in which a laminate of sublimation-type inkjet textile printing transfer paper and a fabric such as polyester that is a transfer target object is brought into close contact with a heating dryer to thermally sublimate printing ink on the sublimation-type inkjet textile printing transfer paper, thereby performing transfer printing on the transfer target object. The sublimation-type textile printing transfer method has an advantage in that printing of a sharp design that is difficult with the other transfer methods is enabled without impairing the feel and texture of the textile-printed object.

Patent Literature 1 and 2 each discloses sublimation-type inkjet textile printing transfer paper in which an ink receiving layer containing a pigment such as silica and a binder such as polyvinyl alcohol, etc. is provided on a base material, as the sublimation-type inkjet textile printing transfer paper for the inkjet recording method.

In addition, Patent Literature 3 discloses sublimation-type inkjet textile printing transfer paper including an ink receiving layer containing inorganic particles such as porous inorganic fine particles for improving retention of sublimation-type textile printing ink at the ink receiving layer.

However, in these conventional sublimation-type inkjet textile printing transfer papers, when inkjet printing is performed, sublimation-type textile printing ink passes through a coating layer and reaches a base paper layer as a result of placing importance on the absorbability and dryability of the ink. Thus, there is a problem that, when transfer printing is performed onto a transfer target object, the sublimation-type textile printing ink strikes through to the back side different from the ink receiving layer of the transfer paper, or passes through (strikes through) a fabric or the like that is the transfer target object, and adheres to a pressing machine for transfer, or the like.

Since the absorbability and dryability of the sublimation-type textile printing ink and prevention of strike-through of the sublimation-type textile printing ink contradict each other, it is difficult to produce transfer paper that achieves both of these characteristics, that is, sublimation-type inkjet textile printing transfer paper that immediately absorbs/dries the sublimation-type textile printing ink at the time of printing and that prevents strike-through of the sublimation-type textile printing ink at the time of transfer. Furthermore, for the sublimation-type inkjet textile printing transfer paper, the efficiency of transfer onto the transfer target object, such as the reproducibility of an image, the resolution of a transferred image, the density level of the transferred image, and the uniformity of these, is required at a higher level.

In addition, recent sublimation-type textile printing ink itself has been significantly improved in terms of dryability, and thus the necessity of porous inorganic fine particles, which have been conventionally required for improving retention at the ink receiving layer, has decreased. Conversely, the presence of the porous inorganic fine particles decreases the sublimability of the sublimation-type textile printing ink, and becomes a factor for causing the sublimation-type textile printing ink to remain on the ink receiving layer, and thus improvement has been desired for this.

Moreover, in the case of sublimation-type inkjet textile printing transfer paper provided with an ink receiving layer containing a pigment such as silica, for example, as in the sublimation-type inkjet textile printing transfer paper disclosed in Patent Literature 1 and 2 described above, there is an advantage in that the dryability of the sublimation-type textile printing ink is good when inkjet printing is performed, but the amount of the sublimation-type textile printing ink remaining on the sublimation-type inkjet textile printing transfer paper tends to increase when transfer printing is performed onto the transfer target object. As a result, there is a problem that the transfer onto the transfer target object becomes insufficient, so that the efficiency of transfer onto the transfer target object, such as the resolution of a transferred image, the density level of the transferred image, and the uniformity of these, cannot reach the level required in recent years.

CITATION LIST

Patent Literature

[PTL 1] Japanese Laid-Open Patent Publication No. 2003-276309

[PTL 2] Japanese Laid-Open Patent Publication No. 2002-292995

[PTL 3] Japanese Laid-Open Patent Publication No. 2003-313786

SUMMARY OF THE INVENTION

Problems to be Solved by the Invention (I) The present disclosure provides sublimation-type inkjet textile printing transfer paper (hereinafter, referred to as sublimation-type inkjet textile printing transfer paper I) that is excellent in the receptivity of sublimation-type textile printing ink and has excellent image reproducibility and excellent strike-through prevention at the time of inkjet printing and that is excellent in the efficiency of transfer onto a transfer target object, such as the reproducibility of an image, the resolution of a transferred image, the density level of the transferred image, and the uniformity of these, at the time of transfer printing onto the transfer target object.

(II) The present disclosure provides sublimation-type inkjet textile printing transfer paper (hereinafter, referred to as sublimation-type inkjet textile printing transfer paper II) that is excellent in the dryability of sublimation-type textile printing ink at the time of inkjet printing and that has a small amount of the sublimation-type textile printing ink remaining thereon and is excellent in the efficiency of transfer onto a transfer target object, such as the reproducibility of an image, the resolution of a transferred image, the density level of the transferred image, and the uniformity of these, at the time of transfer printing onto the transfer target object. In addition, the present disclosure provides a simple production method for the sublimation-type inkjet textile printing transfer paper II (hereinafter, referred to as production method II for the transfer paper II.

(III) The present disclosure provides sublimation-type inkjet textile printing transfer paper (hereinafter, referred to as sublimation-type inkjet textile printing transfer paper III) that is excellent in the dryability of sublimation-type textile printing ink at the time of inkjet printing and that has a small amount of the sublimation-type textile printing ink remaining thereon and is excellent in the efficiency of transfer onto a transfer target object, such as the reproducibility of an image, the resolution of a transferred image, the density level of the transferred image, and the uniformity of these, at the time of transfer printing onto the transfer target object. In addition, the present disclosure provides a simple production method for the sublimation-type inkjet textile printing transfer paper III that is excellent in operability (hereinafter, referred to as production method III for the transfer paper III).

Solution to the Problems (I) The sublimation-type inkjet textile printing transfer paper I according to the present disclosure includes a base material and a sublimation-type textile printing ink receiving layer formed on the base material, the base material has a 10-second Cobb water absorption, conforming to JIS P 8140, of 5 to 20 g/m$^2$, the sublimation-type textile printing ink receiving layer is made from an ink receiving layer coating material containing a water soluble resin and fine particles, the water soluble resin is at least a sodium carboxymethyl cellulose, and the sodium carboxymethyl cellulose is contained in the ink receiving layer coating material in a ratio of 100 to 400 parts by mass with respect to 100 parts by mass of the fine particles, the fine particles are at least inorganic fine particles having a tabular crystal structure, the inorganic fine particles having a tabular crystal structure have a median diameter d50 in a range of 0.4 to 2.3 μm and have an aspect ratio of 5 to 30, a coating amount (dry) of the ink receiving layer coating material is 3 to 13 g/m$^2$, and based on the number of appearance of n-hexadecane traces appearing on a surface of the base material, on which the sublimation-type textile printing ink receiving layer is not formed, at each dripped location 1 minute after one drop of n-hexadecane is dripped to each of five locations on the sublimation-type textile printing ink receiving layer by using a dripping method based on an oil absorbency test method conforming to JIS P 3001 (1976) using n-hexadecane, an average of the numbers of appearance at the five locations is not greater than 5.

(II) The sublimation-type inkjet textile printing transfer paper II according to the present disclosure includes a base material and a sublimation-type textile printing ink receiving layer formed on the base material, the base material has a 10-second Cobb water absorption, conforming to JIS P 8140, of 5 to 20 g/m$^2$, the sublimation-type textile printing ink receiving layer is made from a mixed coating material of an ink receiving layer coating material A containing a water soluble resin A and fine particles A and an ink receiving layer coating material B containing a water soluble resin B and fine particles B, in the ink receiving layer coating material A, the water soluble resin A is at least a sodium carboxymethyl cellulose, and the sodium carboxymethyl cellulose is contained in the ink receiving layer coating material A in a ratio of 100 to 400 parts by mass with respect to 100 parts by mass of the fine particles A, the fine particles A are at least inorganic fine particles having a tabular crystal structure, and the inorganic fine particles having a tabular crystal structure have a median diameter d50 in a range of 0.4 to 2.3 μm and have an aspect ratio of 5 to 30, based on the number of appearance of n-hexadecane traces appearing on a surface of the base material, on which a layer A is not formed, at each dripped location 1 minute after one drop of n-hexadecane is dripped to each of different five locations on the layer A, which is formed on the base material from the ink receiving layer coating material A, by using a dripping method based on an oil absorbency test method conforming to JIS P 3001 (1976) using n-hexadecane, an average of the numbers of appearance at the five locations is not greater than 5, in the ink receiving layer coating material B, the water soluble resin B is at least a sodium carboxymethyl cellulose, and the fine particles B are at least silica particles, and a coating amount (dry) of the mixed coating material is 2 to 12 g/m$^2$.

In addition, the production method II for the transfer paper II according to the present disclosure includes the steps of:

preparing the ink receiving layer coating material A from at least the water soluble resin A and the fine particles A;

preparing the ink receiving layer coating material B from at least the water soluble resin B and the fine particles B;

mixing the ink receiving layer coating material A and the ink receiving layer coating material B to prepare the mixed coating material; and applying the mixed coating material onto the base material to form the sublimation-type textile printing ink receiving layer on the base material.

(III) The sublimation-type inkjet textile printing transfer paper III according to the present disclosure includes a base material and a sublimation-type textile printing ink receiving layer formed on the base material, the base material has a 10-second Cobb water absorption, conforming to JIS P 8140, of 5 to 20 g/m$^2$, the sublimation-type textile printing ink receiving layer is made from an ink receiving layer coating material containing at least a water soluble resin, fine particles A, and fine particles B, the water soluble resin is at least a sodium carboxymethyl cellulose, the fine particles A are at least inorganic fine particles having a tabular crystal structure, and the inorganic fine particles having a tabular crystal structure have a median diameter d50 in a range of 0.4 to 2.3 μm and have an aspect ratio of not less than 5, the fine particles B are at least silica particles, a ratio of the fine particles A and the fine particles B (fine particles A/fine particles B) is 15/85 to 90/10 as a mass ratio, an amount of the sodium carboxymethyl cellulose in solid content is not less than the sum of 50 parts by mass with respect to 100 parts by mass of the fine particles A and 120 parts by mass with respect to 100 parts by mass of the fine particles B and not greater than 400 parts by mass with respect to 100 parts by mass in total of the fine particles A and fine particles B, and a coating amount (dry) of the ink receiving layer coating material is 2 to 12 g/m$^2$.

In addition, the production method III for the transfer paper III according to the present disclosure includes the steps of:

preparing a high-density dispersion of the fine particles A, then adding a solvent to the high-density dispersion in a predetermined ratio to dilute the high-density dispersion, and immediately adding and dispersing the fine particles B in an obtained diluted dispersion, to prepare a mixed dispersion slurry of the fine particles A and the fine particles B;

adding and mixing the water soluble resin into the mixed dispersion slurry to prepare the ink receiving layer coating material; and applying the ink receiving layer coating material onto the base material to form the sublimation-type textile printing ink receiving layer on the base material.

In the present disclosure, the sublimation-type inkjet textile printing transfer paper I, the sublimation-type inkjet textile printing transfer paper II, and the sublimation-type inkjet textile printing transfer paper III are collectively referred to merely as sublimation-type inkjet textile printing transfer paper. In addition, the production method II for the transfer paper II and the production method III for the transfer paper III are also collectively referred to merely as production method for sublimation-type inkjet textile printing transfer paper.

Advantageous Effects of the Invention

The sublimation-type inkjet textile printing transfer paper I according to the present disclosure is excellent in the receptivity of sublimation-type textile printing ink and has excellent image reproducibility and excellent strike-through prevention at the time of inkjet printing, and is excellent in the efficiency of transfer onto a transfer target object, such as the reproducibility of an image, the resolution of a transferred image, the density level of the transferred image, and the uniformity of these, at the time of transfer printing onto the transfer target object.

The sublimation-type inkjet textile printing transfer paper II according to the present disclosure is excellent in the dryability of sublimation-type textile printing ink at the time of inkjet printing, and has a small amount of the sublimation-type textile printing ink remaining thereon and is excellent in the efficiency of transfer onto a transfer target object, such as the reproducibility of an image, the resolution of a transferred image, the density level of the transferred image, and the uniformity of these, at the time of transfer printing onto the transfer target object.

In addition, by the production method II for the transfer paper II according to the present disclosure, the sublimation-type inkjet textile printing transfer paper II having such excellent characteristics can be efficiently produced through simple steps.

The sublimation-type inkjet textile printing transfer paper III according to the present disclosure is excellent in the dryability of sublimation-type textile printing ink at the time of inkjet printing, has less powder falling from the paper surface due to peeling of the ink receiving layer, and also has a small amount of the sublimation-type textile printing ink remaining thereon and is excellent in the efficiency of transfer onto a transfer target object, such as the reproducibility of an image, the resolution of a transferred image, the density level of the transferred image, and the uniformity of these, at the time of transfer printing onto the transfer target object.

In addition, the production method III for the transfer paper III according to the present disclosure has excellent operability, and the sublimation-type inkjet textile printing transfer paper III having such excellent characteristics can be efficiently produced through simple steps by the production method III for the transfer paper III.

DESCRIPTION OF EMBODIMENTS

Hereinafter, embodiments will be described in detail with reference to the drawings as appropriate. However, there will be instances in which detailed description beyond what is necessary is omitted. For example, detailed description of subject matter that is previously well known, as well as redundant description of components that are substantially the same will in some cases be omitted. This is to prevent the following description from being unnecessarily lengthy, in order to facilitate understanding by a person of ordinary skill in the art. Furthermore, in the drawings, principal components are schematically illustrated for easy understanding.

The inventors provide the following description and the accompanying drawings in order to allow a person of ordinary skill in the art to sufficiently understand the present disclosure, and the description and the drawings are not intended to restrict the subject matter of the scope of the patent claims.

Embodiment I: Sublimation-Type Inkjet Textile Printing Transfer Paper I

The sublimation-type inkjet textile printing transfer paper I according to the present disclosure is sublimation-type inkjet textile printing transfer paper in which a sublimation-type textile printing ink receiving layer is formed on a base material. The sublimation-type textile printing ink receiving layer is made from an ink receiving layer coating material containing a water soluble resin and fine particles.

The base material used in the sublimation-type inkjet textile printing transfer paper I is not particularly limited as long as the base material is a base material on which the sublimation-type textile printing ink receiving layer can be provided and does not cause excessive thermal shrinkage by heating at the time of thermal transfer. Examples of the base material include paper containing wood pulp as a principal component, a porous resin film made from a thermoplastic resin containing inorganic fine particles, a nonwoven fabric, a fabric, resin-coated paper, and synthetic paper.

In the present disclosure, "containing as a principal component" refers to making up for 50% by mass or more of the total amount of all components.

The base material with which the advantageous effects of the sublimation-type inkjet textile printing transfer paper I significantly appear is a porous material with which sublimation-type textile printing ink is easily sublimated by heating the back surface of the sublimation-type inkjet textile printing transfer paper I. Specifically, such a base material is paper containing wood pulp as a principal component, a nonwoven fabric, a fabric, or the like.

As the base material, paper containing wood pulp as a principal component is preferably used, and kraft paper is particularly preferably used. The kraft paper has excellent dimension stability, is recyclable unlike a film, and has a feature of having excellent absorbability and dryability of the sublimation-type textile printing ink.

An example in which the kraft paper is taken as an example of a suitably used base material will be described below. The kraft paper used suitably in the sublimation-type inkjet textile printing transfer paper I is paper that satisfies the quality as conventional packaging paper as specified in JIS P 3401, or machine glazed paper that falls within the category of kraft paper and that is obtained through drying with a Yankee dryer. These materials have excellent dimension stability, and thus excellent image reproducibility can be achieved.

The base material used in the sublimation-type inkjet textile printing transfer paper I has a basis weight of preferably 50 to 140 g/m$^2$ and more preferably 55 to 110 g/m$^2$. If the basis weight is less than 50 g/m$^2$, in the case of a current inkjet printer, because of the performance of the printer, cockling (waving) due to soaking of ink into the kraft paper occurs in a normal amount of the ink. On the other hand, at the time of heating for transfer, shrinkage of the kraft paper occurs, the adhesiveness with a fabric that is a transfer target object decreases, and thus the quality of a transferred image tends to decrease. In addition, due to a decrease in tensile strength and tear strength, paper breakage easily occurs. If the basis weight exceeds 140 g/m$^2$, heat transmission to the transfer target object deteriorates at the time of heating transfer of the sublimation-type textile printing ink, and thus the transfer efficiency tends to decrease.

The coating surface of the ink receiving layer coating material on the base material has a Bekk smoothness, conforming to JIS P 8119, of preferably 30 to 400 seconds and more preferably 50 to 300 seconds. If the Bekk smoothness is less than 30 seconds, a difference between a portion at which the sublimation-type textile printing ink receiving layer infiltrates into the base material and a portion at which the sublimation-type textile printing ink receiving layer does not infiltrate into the base material easily appears, which may be considered to be due to the unevenness of the surface of the base material, and thus a coating defect tends to easily occur. In addition, the absorbability and dryability of the sublimation-type textile printing ink at the time of printing becomes high, but the image reproducibility tends decrease, or the image reproducibility and the transfer efficiency at the time of transfer of the sublimation-type textile printing ink to the transfer target object tend to decrease. These tendencies are improved by increasing smoothness. Particularly regarding the machine glazed paper, the back surface dried with a Yankee dryer (the surface at the wire side of a paper machine=Yankee surface) has high smoothness. Thus, the machine glazed paper has a low risk of occurrence a coating defect by coating the Yankee surface, has excellent image reproducibility and strike-through prevention for the sublimation-type textile printing ink, and is excellent in the efficiency of transfer to a transfer target object, such as the reproducibility of an image, the resolution of a transferred image, the density level of the transferred image, and the uniformity of these, at the time of transfer printing onto the transfer target object. Moreover, since planarization treatment is not performed at the front surface side of the base material, the machine glazed paper has an effect of improving thermal sublimation of the sublimation-type textile printing ink when being brought into close contact with a heating dryer to perform heating transfer of the sublimation-type textile printing ink. However, if the Bekk smoothness exceeds 400 seconds, the adhesiveness between the sublimation-type textile printing ink receiving layer and the base material decreases, and a thin portion of the ink receiving layer tends to easily induce a coating defect. In addition, unevenness occurs in formation of the sublimation-type textile printing ink receiving layer, and the image reproducibility tends to decrease.

The kraft paper that can be used in the sublimation-type inkjet textile printing transfer paper I is formed from a material used in the so-called papermaking field. The pulp to be used is not particularly limited, but examples thereof include: chemical pulp such as needle-leaved tree non-bleached kraft pulp (NUKP), needle-leaved tree bleached kraft pulp (NBKP), broad-leaved tree non-bleached kraft pulp (LUKP), and broad-leaved tree bleached kraft pulp (LBKP); mechanical pulp such as thermomechanical pulp (TMP), chemithermomechanical pulp (CTMP), refiner mechanical pulp (RMP), refiner ground pulp (RGP), chemi-ground pulp (CGP), thermos-ground pulp (TGP), ground pulp (GP), stone ground pulp (SGP), and pressurized stone ground pulp (PGW); and waste paper pulp including chemical pulp and mechanical pulp, such as dinking pulp (DIP) and waste pulp (WP). One or more types can be selected from among these pulps and used. Among these pulps, broad-leaved tree kraft pulp is preferably used, and broad-leaved tree bleached kraft pulp and needle-leaved tree bleached kraft pulp are further preferably combined as appropriate and used, in terms of paper strength, evenness of the surface of the base material, and quality verification of a printed image of the sublimation-type textile printing ink on the sublimation-type inkjet textile printing transfer paper I.

In the base material in the present disclosure, chemical additives, such as various starches such as oxidized starch, acetylated starch, esterified starch, and etherified starch, a paper strengthening agent, an internal sizing agent such as an alkyl ketene dimer, an external sizing agent, and a yield improving agent, can be blended, and further a filler such as titanium oxide, clay, talc, and calcium carbonate can be blended in an adjustable range.

The base material in the present disclosure has a 10-second Cobb water absorption, conforming to JIS P 8140, of 5 to 20 g/m$^2$ and preferably 10 to 16 g/m$^2$. If the 10-second Cobb water absorption is less than 5 g/m$^2$, the adhesiveness between the sublimation-type textile printing ink receiving layer and the base material deteriorates, and a thin portion partially occurs in the ink receiving layer and induces a coating defect in which a continuous coating of the ink receiving layer cannot be maintained. If the 10-second Cobb water absorption exceeds 20 g/m$^2$, the sublimation-type textile printing ink receiving layer easily infiltrates into the base material, and a portion at which the sublimation-type textile printing ink receiving layer partially deeply infiltrates into the base material induces a coating defect in which the continuous coating of the ink receiving layer cannot be maintained.

In the sublimation-type inkjet textile printing transfer paper I, the sublimation-type textile printing ink receiving layer is made from the ink receiving layer coating material containing the water soluble resin and the fine particles and is formed on the base material.

The water soluble resin is used mainly as a binder in a normal coating material. However, in the present disclosure, the water soluble resin is at least a sodium carboxymethyl cellulose (hereinafter, referred to as CMC) since the CMC has a characteristic of trapping and absorbing the sublimation-type textile printing ink, but compounds other than the CMC can be used. Examples of the compounds other than the CMC include: starch; starch derivatives such as oxidized starch, cationized starch, etherified starch, and phosphorylated starch; cellulose derivatives such as hydroxymethyl cellulose, hydroxyethyl cellulose, and cellulose sulfate; polyvinyl alcohols (hereinafter, referred to as PVAs) having various saponification degrees; various PVA derivatives such as silanol-modified products, carboxylated products, and cationized products of PVAs; water-soluble natural polymer compounds such as casein, gelatin, modified gelatin, and soybean protein; and water-soluble synthetic polymer compounds such as polyvinyl pyrrolidone, sodium polyacrylate, styrene-maleic anhydride copolymer sodium salt, and sodium polystyrene sulfonate. One or more compounds can be selected from these compounds and used in combination with the CMC.

In order to make the sublimation-type textile printing ink receiving layer exhibit performance of very rapidly absorbing/drying the sublimation-type textile printing ink, which is one of problems to be solved by the sublimation-type inkjet textile printing transfer paper I according to the present disclosure, at least the CMC is used as the water soluble resin. However, the polymerization degree or the molecular weight of the CMC is also considered to influence this performance, and thus, preferably, a CMC having a predetermined polymerization degree and a predetermined molecular weight is used, and the temperature is controlled at the time of application of the ink receiving layer coating material.

Examples of a suitably used CMC include a CMC having a polymerization degree of 30 to 180 and a weight-average molecular weight of 6600 to 40000. The CMC having a polymerization degree of 30 to 180 and a weight-average molecular weight of 6600 to 40000 allows a sublimation-type textile printing ink receiving layer having less coating defect to be easily formed in terms of viscosity and workability, and also can make application of the ink receiving layer coating material easy. If the polymerization degree is less than 30 and the weight-average molecular weight is less than 6600, the viscosity of the CMC is low, which leads to a phenomenon of a coating film of the ink receiving layer being torn, and thus a defect is thought to easily occur in the continuous coating. If the polymerization degree is greater than 180 and the weight-average molecular weight is greater than 40000, the workability in an application process may decrease. For example, the application may be difficult since the viscosity of the CMC is excessively high, a drying load may be applied when the solid content is reduced for decreasing the viscosity, or film formation may be adversely affected when the CMC is kept at a high temperature for a long period of time for decreasing the viscosity.

In addition, for example, a CMC having an etherification degree of about 0.5 to 1.0 can be used.

Specific examples of the CMC include CELLOGEN 5A and CELLOGEN 7A (trade names, manufactured by DKS Co. Ltd., "CELLOGEN" is a registered trademark), and FINNFIX 2 and FINNFIX 5 (trade names, manufactured by CP Kelco, "FINNFIX" is a registered trademark).

In the ink receiving layer coating material, that is, in the sublimation-type textile printing ink receiving layer, the CMC is contained in a ratio of 100 to 400 parts by mass with respect to 100 parts by mass of the fine particles, and is preferably contained in a ratio of 150 to 300 parts by mass with respect to 100 parts by mass of the fine particles. If the amount of the CMC is less than 100 parts by mass, the absorbability and dryability of the sublimation-type textile printing ink only with the CMC is not sufficient, and use of the CMC in combination with fine particles having high ink absorbability is essential. If the amount of the CMC exceeds 400 parts by mass, the barrier effect of absorption of the sublimation-type textile printing ink by the fine particles decreases, and the sublimation-type textile printing ink remains on the ink receiving layer.

In the sublimation-type inkjet textile printing transfer paper I, a PVA can be used together with the CMC as the water soluble resin. Among PVAs, a PVA particularly having a saponification degree of about 87 to 99 mol % and further about 98 to 99 mol % and a polymerization degree of not greater than about 1700, further not greater than about 1000, and particularly not greater than 500 has favorable compatibility with the CMC, and has an effect of causing the sublimation-type textile printing ink to remain on the sublimation-type textile printing ink receiving layer as appropriate. In addition, such a PVA also has an effect of dispersing inorganic fine particles that have a tabular crystal structure and are the fine particles.

Specific examples of the PVA include Kuraray Poval PVA 110 and Kuraray Poval PVA 105 (trade names, manufactured by Kuraray Co., Ltd.).

When the PVA is used together with the CMC as the water soluble resin, the amount of the PVA in the ink receiving layer coating material, that is, in the sublimation-type textile printing ink receiving layer, in solid content is preferably not greater than 15 parts by mass and further preferably not greater than 8 parts by mass with respect to 100 parts by mass of the fine particles. By adjusting the amount of the PVA within this range, more excellent absorbability/dryability of the sublimation-type textile printing ink can be achieved. If the amount of the PVA exceeds 15 parts by mass, a sign that film formation by the PVA hinders film formation by the CMC may appear, and a coating defect may be induced.

Furthermore, when the ink receiving layer coating material is prepared by using the CMC and the PVA in combination, the PVA is preferably added to the fine particles earlier than the CMC, from the standpoint that an effect of further reducing coating defects is achieved. The reason for this is not clear, but it is thought that inhibition of film formation by the CMC more easily occurs as the amount of the free PVA becomes larger, and by bringing the PVA into contact with the fine particles earlier than the CMC, the amount of the PVA trapped by the fine particles becomes larger, so that inhibition of film formation by the CMC is reduced.

The fine particles contained in the ink receiving layer coating material are at least inorganic fine particles having a tabular crystal structure.

In the sublimation-type textile printing ink receiving layer formed from the ink receiving layer coating material, the inorganic fine particles having a tabular crystal structure are contained as a filler in combination with the water soluble resin. Thus, the absorbability and dryability of the sublimation-type textile printing ink at the time of printing significantly improves, for example, due to the synergistic effect with a penetrant contained in the base material, and the sublimation-type inkjet textile printing transfer paper I can achieve excellent characteristics in terms of image reproducibility, heat resistance at the time of heating transfer, image reproducibility on the surface of a transfer target object after transfer, and transfer efficiency.

As the inorganic fine particles having a tabular crystal structure, for example, delaminated clay or secondary clay having hydrophilicity is suitably used. By using inorganic fine particles having a median diameter d50 in a range of 0.4 to 2.3 μm and preferably in a range of 0.4 to 1.4 μm and having an aspect ratio of 5 to 30 and preferably 8 to 20, an ink barrier layer can be formed by the inorganic fine particles without inhibiting formation of a continuous coating of the CMC. With inorganic fine particles having a median diameter of less than 0.4 μm and an aspect ratio of less than 5, a sufficient ink barrier layer cannot be formed. With inorganic fine particles having a median diameter exceeding 2.3 μm, sedimentation of the fine particles easily occur in the ink receiving layer coating material, handleability such as feedability of the coating material decreases, and quality stabilization is inhibited. With inorganic fine particles having an aspect ratio exceeding 30, the barrier properties become excessively high, which decreases the ink dryability.

The particle diameter of the fine particles in the present disclosure is measured using a 50 μm aperture with a Coulter counter method particle size measuring instrument (TA-II model, manufactured by COULTER ELECTRONICS INS) for a solution obtained by adding a small amount of a sample to a methanol solution and dispersing the sample with an ultrasonic dispersion machine for 3 minutes.

As long as the advantageous effects of the sublimation-type inkjet textile printing transfer paper I are achieved, it is possible to blend other fine particles together with the inorganic fine particles having a tabular crystal structure. Examples of the other fine particles include: inorganic pigments, such as precipitated calcium carbonate, heavy calcium carbonate, magnesium carbonate, magnesium hydroxide, talc, calcium sulfate, barium sulfate, titanium dioxide, zinc oxide, zinc sulfide, zinc carbonate, satin white, aluminum silicate, diatom earth, calcium silicate, magnesium silicate, alumina, colloidal alumina, hydrated alumina such as pseudo-boehmite, aluminium hydroxide, lithopone, zeolite, hydrated halloysite, magnesium hydroxide, and synthetic amorphous silica; and organic pigments such as styrene-based plastic pigments, acrylic-based plastic pigments, polyethylene, microcapsule, urea resin, and melamine resin. One type of these fine particles can be used solely, or two or more types of these fine particles can be selected as appropriate and used.

The amount of the fine particles contained in the ink receiving layer coating material, that is, in the sublimation-type textile printing ink receiving layer, is preferably 17 to 60 parts by mass and more preferably 20 to 50 parts by mass with respect to 100 parts by mass of the ink receiving layer coating material (sublimation-type textile printing ink receiving layer). If the amount of the fine particles is less than 17 parts by mass, the amount of the sublimation-type textile printing ink received increases, but formation of an ink barrier layer by the fine particles is insufficient, sublimation efficiency at the time of transfer tends to decrease, and a problem of fouling may arise. If the amount of the fine particles exceeds 60 parts by mass, the ink barrier layer becomes excessive, the amount of the sublimation-type textile printing ink received decreases, and the ink dryability tends to decrease.

The method for preparing the ink receiving layer coating material is not particularly limited. However, for example, when a fine particle-dispersed slurry having a low temperature of about 20 to 30° C. is added to the CMC having a high temperature of 65 to 80° C., aggregation of the fine particles occurs, a state where the fine particles are uniformly spread over the coating surface is less likely to be produced, and formation of an ink barrier layer is inhibited. Thus, such a preparation method is not preferable. From the standpoint that a coating material can be made while a state where the fine particles are dispersed is maintained, a method in which the water soluble resin such as the CMC and the PVA is added to the fine particle-dispersed slurry and is mixed and dispersed therein at about 20 to 45° C., can be suitably adopted.

The solid content concentration of the ink receiving layer coating material obtained as described above is not particularly limited. Because of the characteristics of the CMC that is a principal component, in order to form a continuous coating, preferably, the solid content concentration is higher, the viscosity is higher, and the molecular weight is higher. However, if the solid content concentration is excessively high, the viscosity of the ink receiving layer coating material increases, which contradicts the application workability. Thus, practically, the solid content concentration is preferably about 10 to 25%. If the solid content concentration of the ink receiving layer coating material is less than 10%, the ink receiving layer coating material easily infiltrates into the base material, and it is necessary to increase the coating amount in order to obtain a continuous coating, but the amount of moisture to be removed in drying becomes excessively large, and drying wrinkles tend to occur. As a result, the appearance of the paper may deteriorate and heat transmission at the time of ink transfer may also become uneven due to paper wrinkles. If the solid content concentration of the ink receiving layer coating material exceeds 25%, the viscosity of the ink receiving layer coating material increases, and it becomes difficult to control the coating amount by a normal coating method.

The sublimation-type inkjet textile printing transfer paper I can be produced by applying the ink receiving layer coating material to the base material to form the sublimation-type textile printing ink receiving layer containing the water soluble resin and the fine particles on the base material.

The method for applying the ink receiving layer coating material is not particularly limited, but in order to efficiently achieve the advantageous effects of the sublimation-type inkjet textile printing transfer paper I, the ink receiving layer coating material prepared as described above can be applied by using a coating machine such as an air knife coater, a roll coater, a bar coater, a comma coater, and a blade coater. Among these coating machines, an air knife coater is preferably used in terms of inhibition of streak occurrence due to presence of the fine particles serving as a filler and formation of a uniform sublimation-type textile printing ink receiving layer by contour application to the paper surface.

The coating amount (dry) of the ink receiving layer coating material is in a range of 3 to 13 g/m$^2$ and preferably in a range of 5 to 11 g/m$^2$. If the coating amount of the ink receiving layer coating material is less than 3 g/m$^2$, it is difficult to fully coat the base material with the coating material, and coating defects such as fine uncoated portions, that is, pinholes, occur. If the coating amount of the ink receiving layer coating material exceeds 13 g/m$^2$, printing and transfer quality of the sublimation-type textile printing ink improves by an increase in the coating amount, but a curl or unevenness of the transfer surface occurs due to the difference in the degree of dimensional change due to shrinkage of the paper between the sublimation-type textile printing ink receiving layer and the base material, during heat transmission at the time of thermal transfer. Thus, the adhesion between the fabric and the paper becomes ununiform, which becomes a factor for occurrence of transfer density unevenness.

In the sublimation-type inkjet textile printing transfer paper I produced as described above, based on the number of appearance of n-hexadecane traces (hereinafter, referred to merely as pinhole appearance I) appearing on the surface of the base material, on which the sublimation-type textile printing ink receiving layer is not formed, at each dripped location 1 minute after one drop of n-hexadecane is dripped to each of different five locations on the sublimation-type textile printing ink receiving layer by using a dripping method based on an oil absorbency test method conforming to JIS P 3001 (1976) using n-hexadecane, the average of the numbers of the pinhole appearance I at the five locations is not greater than 5 and preferably not greater than 3. If the average of the numbers of the pinhole appearance I exceeds 5, the efficiency of transfer of the sublimation-type textile printing ink at each pinhole portion decreases and image reproducibility deteriorates. In addition, relatively large pinholes may occur, so that fouling of an inkjet printer occurs due to strike-through of the sublimation-type textile printing ink, or pinhole-like voids occur in a transferred image in an extreme case.

In order to adjust the average of the numbers of the pinhole appearance I to be not greater than 5, for example, the following methods can be adopted. Specifically, a method in which paper containing wood pulp as a principal component is used as the base material and the type of the material pulp, beating treatment, and the like are adjusted as appropriate, a method in which kraft paper is particularly used as the base material, and freeness (CSF) conforming to JIS P 8121-2 after the sublimation-type inkjet textile printing transfer paper I is disintegrated in compliance with JIS P 8220 is adjusted to about 350 to 650 ml, and a method in which the type, the concentration, the viscosity, and the like of the water soluble resin to be blended into the ink receiving layer coating material are adjusted, can also be adopted.

The sublimation-type inkjet textile printing transfer paper I is sublimation-type inkjet textile printing transfer paper in which, as described above, the sublimation-type textile printing ink receiving layer is formed on the base material and the average of the numbers of the pinhole appearance I is not greater than 5. Among these, sublimation-type inkjet textile printing transfer paper, in which the base material is made from pulp containing broad-leaved tree kraft pulp as a principal component, the sublimation-type textile printing ink receiving layer is formed on one surface of the base material, a resin composition that contains a water soluble resin and does not contain a filler is applied to the other surface of the base material such that the solid content amount of the water soluble resin is 0.15 to 3.5 g/m$^2$, and the viscosity, at 30° C., of a 15% solution of the CMC that is contained in the sublimation-type textile printing ink receiving layer is 0.15 to 6 Pa·s, particularly considerably achieves the advantageous effects as the sublimation-type inkjet textile printing transfer paper I.

The resin composition to be applied to the surface (back surface) of the base material on which the sublimation-type textile printing ink receiving layer is not formed contains a water soluble resin that is the same as the water soluble resin used when the sublimation-type textile printing ink receiving layer is formed, but does not contain a filler such as fine particles. Thus, an effect that a coating is easily formed by the water soluble resin in a small coating amount is particularly achieved. The coating of the water soluble resin on the back surface prevents a curl at the time of printing and transfer and also has an effect of preventing fouling of a facility at the time of printing and transfer due to passing of the sublimation-type textile printing ink to the back surface.

The resin composition is preferably applied such that the solid content amount of the water soluble resin is preferably 0.15 to 3.5 g/m$^2$ and further preferably 0.3 to 2.5 g/m$^2$. Accordingly, the effect of preventing fouling of the facility at the time of printing and transfer due to passing of the ink to the back surface is sufficiently exhibited by the formation of the coating of the water soluble resin. In addition, by preventing the coating amount from being excessively large, the paper is not made harder than necessary, tendency of occurrence of unevenness of the paper surface or wrinkles from strain due to shrinkage of the paper at the time of thermal transfer is prevented, and occurrence of transfer density unevenness can be inhibited.

In addition, regarding the CMC contained in the sublimation-type textile printing ink receiving layer, the viscosity, at 30° C., of a 15% solution of the CMC is preferably 0.15 to 6 Pa·s and further preferably 0.2 to 5 Pa·s. Accordingly, since the viscosity of the CMC is low, a phenomenon that the coating film of the sublimation-type textile printing ink receiving layer is torn is not caused, and a defect does not occur in the continuous coating. On the other hand, the following can also be avoided: coating may be difficult since the viscosity of the CMC is excessively high, a drying load may be applied when the solid content is reduced for decreasing the viscosity, or film formation may be adversely affected when the CMC is kept at a high temperature for a long period of time for decreasing the viscosity.

Furthermore, when an under layer is formed between the sublimation-type textile printing ink receiving layer and the base material in the sublimation-type inkjet textile printing transfer paper I, and contains the CMC that is the principal component of the sublimation-type textile printing ink receiving layer, the sublimation-type inkjet textile printing transfer paper I achieves particularly significant effects.

When the under layer containing the CMC is formed between the sublimation-type textile printing ink receiving layer and the base material, an effect that a continuous coating having no pinhole is easily obtained in a smaller coating amount is particularly achieved by a wet coating material, which is in contact with the surface of the base material, becoming fitted therewith immediately after application.

The amount of the CMC contained in the under layer is not particularly limited, but is preferably about 60 to 100% by mass.

The under layer coating material for forming the under layer may contain, in addition to the CMC, components such as: starch; starch derivatives such as oxidized starch, cationized starch, etherified starch, and phosphorylated starch; cellulose derivatives such as hydroxymethyl cellulose, hydroxyethyl cellulose, and cellulose sulfate; PVAs having various saponification degrees; various PVA derivatives such as silanol-modified products, carboxylated products, and cationized products of PVAs; water-soluble natural polymer compounds such as casein, gelatin, modified gelatin, and soybean protein; and water-soluble synthetic polymer compounds such as polyvinyl pyrrolidone, sodium polyacrylate, styrene-maleic anhydride copolymer sodium salt, and sodium polystyrene sulfonate. The under layer coating material is not particularly limited as long as the advantageous effects achieved by the provision of the under layer are not impaired.

In addition, a coating material that is the same as the ink receiving layer coating material may be used as the under layer coating material. In this case, a coating defect can be sufficiently prevented in a coating amount that is smaller than that when the ink receiving layer coating material is applied once.

As described above, in the sublimation-type inkjet textile printing transfer paper I, the sublimation-type textile printing ink receiving layer containing at least the CMC, which is the water soluble resin, and the inorganic fine particles having a tabular crystal structure, which are the filler, in a specific ratio is formed on the base material having a specific water absorption, and pinhole appearance I is very little. Thus, the sublimation-type inkjet textile printing transfer paper I is excellent in the absorbability and dryability of the sublimation-type textile printing ink and has excellent image reproducibility and strike-through prevention at the time of inkjet printing, and is also excellent in the efficiency of transfer onto a transfer target object, such as the reproducibility of an image, the resolution of a transferred image, the density level of the transferred image, and the uniformity of these, at the time of transfer printing onto the transfer target object.

Embodiment II: Sublimation-Type Inkjet Textile Printing Transfer Paper II and Production Method II for Transfer Paper II The sublimation-type inkjet textile printing transfer paper II according to the present disclosure is sublimation-type inkjet textile printing transfer paper in which a sublimation-type textile printing ink receiving layer is formed on a base material. The sublimation-type textile printing ink receiving layer is made from a mixed coating material of an ink receiving layer coating material A containing a water soluble resin A and fine particles A and an ink receiving layer coating material B containing a water soluble resin B and fine particles B.

The type of the base material used in the sublimation-type inkjet textile printing transfer paper II, for example, the type, the characteristics, and the like of a suitably used base material such as kraft paper, may be the same as those of the base material in the sublimation-type inkjet textile printing transfer paper I.

Similarly to the base material in the sublimation-type inkjet textile printing transfer paper I, the base material used in the sublimation-type inkjet textile printing transfer paper II also has a basis weight of preferably 50 to 140 g/m$^2$ and more preferably 55 to 110 g/m$^2$.

Similarly to the base material in the sublimation-type inkjet textile printing transfer paper I, the coating surface of the mixed coating material on the base material used in the sublimation-type inkjet textile printing transfer paper II also has a Bekk smoothness, conforming to JIS P 8119, of preferably 30 to 400 seconds and more preferably 50 to 300 seconds.

Similarly to the base material in the sublimation-type inkjet textile printing transfer paper I, also in the base material used in the sublimation-type inkjet textile printing transfer paper II, various chemical additives can be blended, and various fillers can be further blended in an adjustable range.

Similarly to the base material in the sublimation-type inkjet textile printing transfer paper I, the base material used in the sublimation-type inkjet textile printing transfer paper II also has a 10-second Cobb water absorption, conforming to JIS P 8140, of 5 to 20 g/m$^2$ and preferably 10 to 16 g/m$^2$.

In the sublimation-type inkjet textile printing transfer paper II, the sublimation-type textile printing ink receiving layer is made from the mixed coating material of the ink receiving layer coating material A containing at least the water soluble resin A and the fine particles A and the ink receiving layer coating material B containing at least the water soluble resin B and the fine particles B and is formed on the base material.

First, the ink receiving layer coating material A will be described.

The water soluble resin A is used mainly as a binder in a normal coating material. However, in the present disclosure, the water soluble resin A is at least a CMC since the CMC has a characteristic of trapping and absorbing the sublimation-type textile printing ink, but compounds other than the CMC can be used. Examples of the compounds other than the CMC include the water-soluble natural polymer compounds and the water-soluble synthetic polymer compounds that can be used in the sublimation-type inkjet textile printing transfer paper I. One or more compounds can be selected from these compounds and used together with the CMC.

In order to make the sublimation-type textile printing ink receiving layer exhibit performance of rapidly absorbing/drying the sublimation-type textile printing ink, which is a feature of the sublimation-type inkjet textile printing transfer paper II according to the present disclosure, at least the CMC is used as the water soluble resin A. However, the polymerization degree or the molecular weight of the CMC is also considered to influence this performance, and thus, preferably, a CMC having a predetermined polymerization degree and a predetermined molecular weight is used, and the temperature is controlled at the time of application of the mixed coating material including the ink receiving layer coating material A.

Similarly to the CMC used in the sublimation-type inkjet textile printing transfer paper I, examples of a suitably used CMC include a CMC having a polymerization degree of 30 to 180 and a weight-average molecular weight of 6600 to 40000. The CMC having a polymerization degree of 30 to 180 and a weight-average molecular weight of 6600 to 40000 allows a sublimation-type textile printing ink receiving layer having less coating defect to be easily formed in terms of viscosity and workability, and also can make application of the mixed coating material, which includes the ink receiving layer coating material A, easy.

In addition, for example, a CMC having an etherification degree of about 0.5 to 1.0 can be used.

Specific examples of the CMC include the same CMC as used in the sublimation-type inkjet textile printing transfer paper I.

In the ink receiving layer coating material A, the CMC is contained in a ratio of 100 to 400 parts by mass with respect to 100 parts by mass of the fine particles A, and is preferably contained in a ratio of 150 to 300 parts by mass with respect to 100 parts by mass of the fine particles A. If the amount of the CMC is less than 100 parts by mass, the absorbability and dryability of the sublimation-type textile printing ink only with the CMC is not sufficient, and use of the CMC in combination with fine particles having high ink absorbability is essential. If the amount of the CMC exceeds 400 parts by mass, the barrier effect of absorption of the sublimation-type textile printing ink by the fine particles A decreases, and the sublimation-type textile printing ink remains on the ink receiving layer.

In the sublimation-type inkjet textile printing transfer paper II, a PVA can be used together with the CMC as the water soluble resin A. Among PVAs, a PVA particularly having a saponification degree of about 87 to 99 mol % and further about 98 to 99 mol % and a polymerization degree of not greater than about 1700, further not greater than about 1000, and particularly not greater than 500 has favorable compatibility with the CMC, and has an effect of causing the sublimation-type textile printing ink to remain on the sublimation-type textile printing ink receiving layer as appropriate. In addition, such a PVA also has an effect of dispersing inorganic fine particles that have a tabular crystal structure and are the fine particles A.

Specific examples of the PVA include the same PVA as used in the sublimation-type inkjet textile printing transfer paper I.

When the PVA is used together with the CMC as the water soluble resin A, the amount of the PVA in the ink receiving layer coating material A in solid content is preferably not greater than 15 parts by mass and further preferably not greater than 8 parts by mass with respect to 100 parts by mass of the fine particles A. By adjusting the amount of the PVA within this range, more excellent absorbability and dryability of the sublimation-type textile printing ink can be achieved. If the amount of the PVA exceeds 15 parts by mass, a sign that film formation by the PVA hinders film formation by the CMC may appear, and a coating defect may be induced.

Furthermore, when the ink receiving layer coating material A is prepared by using the CMC and the PVA in combination, the PVA is preferably added to the fine particles A earlier than the CMC, from the standpoint that an effect of further reducing coating defects is achieved. The reason for this is not clear, but it is thought that inhibition of film formation by the CMC more easily occurs as the amount of the free PVA is larger, and by bringing the PVA into contact with the fine particles A earlier than the CMC, the amount of the PVA trapped by the fine particles A becomes larger, so that inhibition of film formation by the CMC is reduced.

The fine particles A contained in the ink receiving layer coating material A are at least inorganic fine particles having a tabular crystal structure.

In the ink receiving layer coating material A, the inorganic fine particles having a tabular crystal structure are contained as a filler in combination with the water soluble resin A. Thus, the absorbability and dryability of the sublimation-type textile printing ink at the time of printing significantly improves, for example, due to the synergistic effect with a penetrant contained in the base material, and the sublimation-type inkjet textile printing transfer paper II can achieve excellent characteristics in terms of image reproducibility, heat resistance at the time of heating transfer, image reproducibility on the surface of a transfer target object after transfer, and transfer efficiency.

Similarly to the inorganic fine particles having a tabular crystal structure that are used in the sublimation-type inkjet textile printing transfer paper I, as the inorganic fine particles having a tabular crystal structure, for example, delaminated clay or secondary clay having hydrophilicity is suitably used. By using inorganic fine particles having a median diameter d50 in a range of 0.4 to 2.3 μm and preferably in a range of 0.4 to 1.4 μm and having an aspect ratio of 5 to 30 and preferably 8 to 20, an ink barrier layer can be formed by the inorganic fine particles without inhibiting formation of a continuous coating of the CMC. With inorganic fine particles having a median diameter of less than 0.4 μm and an aspect ratio of less than 5, a sufficient ink barrier layer cannot be formed. With inorganic fine particles having a median diameter exceeding 2.3 μm, sedimentation of the fine particles easily occur in the ink receiving layer coating material A, handleability such as feedability of the mixed coating material decreases, and quality stabilization is inhibited. With inorganic fine particles having an aspect ratio exceeding 30, the barrier properties become excessively high, which decreases the ink dryability.

The method for measuring the particle diameter of the fine particles A in the present disclosure is the same as the method in Embodiment I described above.

As long as the advantageous effects of the sublimation-type inkjet textile printing transfer paper II are achieved, it is possible to blend other fine particles together with the inorganic fine particles having a tabular crystal structure. Examples of the other fine particles include: inorganic pigments, such as precipitated calcium carbonate, heavy calcium carbonate, magnesium carbonate, magnesium hydroxide, talc, calcium sulfate, barium sulfate, titanium dioxide, zinc oxide, zinc sulfide, zinc carbonate, satin white, aluminum silicate, diatom earth, calcium silicate, magnesium silicate, alumina, colloidal alumina, hydrated alumina such as pseudo-boehmite, aluminium hydroxide, lithopone, zeolite, hydrated halloysite, and magnesium hydroxide; and organic pigments such as styrene-based plastic pigments, acrylic-based plastic pigments, polyethylene, microcapsule, urea resin, and melamine resin. One type of these fine particles can be used solely, or two or more types of these fine particles can be selected as appropriate and used.

The amount of the fine particles A contained in the ink receiving layer coating material A is preferably 19 to 50 parts by mass and more preferably 24 to 40 parts by mass with respect to 100 parts by mass of the ink receiving layer coating material A. If the amount of the fine particles A is less than 19 parts by mass, the amount of the sublimation-type textile printing ink received increases, but formation of an ink barrier layer by the fine particles A is insufficient, sublimation efficiency at the time of transfer tends to decrease, and a problem of fouling may arise. If the amount of the fine particles A exceeds 50 parts by mass, the ink barrier layer becomes excessive, the amount of the sublimation-type textile printing ink received decreases, and the ink dryability tends to decrease.

The method for preparing the ink receiving layer coating material A is not particularly limited, but, for example, a method that is the same as the method for preparing the ink receiving layer coating material used in the sublimation-type inkjet textile printing transfer paper I can be adopted.

The solid content concentration of the ink receiving layer coating material A obtained as described above is not particularly limited, but is preferably practically about 10 to 25% similarly to the ink receiving layer coating material used in the sublimation-type inkjet textile printing transfer paper I.

In the ink receiving layer coating material A, based on the number of appearance of n-hexadecane traces (hereinafter, referred to merely as pinhole appearance II) appearing on the surface of the base material, on which a layer A is not formed, at each dripped location 1 minute after one drop of n-hexadecane is dripped to each of different five locations on the layer A formed on the base material from the ink receiving layer coating material A, by using a dripping method based on an oil absorbency test method conforming to JIS P 3001 (1976) using n-hexadecane, the average of the numbers of the pinhole appearance II at the five locations is not greater than 5 and preferably not greater than 3. If the average of the numbers of the pinhole appearance II exceeds 5, the efficiency of transfer of the sublimation-type textile printing ink at each pinhole portion decreases and image reproducibility deteriorates. In addition, relatively large pinholes may occur, so that fouling of an inkjet printer occurs due to strike-through of the sublimation-type textile printing ink, or pinhole-like voids occur in a transferred image in an extreme case. The roles of the ink receiving layer coating material A in the mixed coating material are to inhibit ink absorption to a paper surface at portions other than silica particles that are the fine particles B described later, and to increase the amount of ink transfer, and such ink blocking performance can be ensured by making a coating material having less pinhole appearance II.

In order to adjust the average of the numbers of the pinhole appearance II to be not greater than 5, for example, the following methods can be adopted. Specifically, a method in which paper containing wood pulp as a principal component is used as the base material and the type of the material pulp, beating treatment, and the like are adjusted as appropriate, a method in which kraft paper is particularly used as the base material, and freeness (CSF) conforming to JIS P 8121-2 after the base material having the layer A formed thereon is disintegrated in compliance with JIS P 8220 is adjusted to about 350 to 650 ml, and a method in which the type, the concentration, the viscosity, and the like of the water soluble resin A to be blended into the ink receiving layer coating material A are adjusted, can also be adopted.

Next, the ink receiving layer coating material B will be described.

The water soluble resin B is used mainly as a binder in a normal coating material, and is at least a CMC, but compounds other than the CMC can be used. Examples of the compounds other than the CMC include the water-soluble natural polymer compounds and the water-soluble synthetic polymer compounds that can be used in the sublimation-type inkjet textile printing transfer paper I. One or more compounds can be selected from these compounds and used together with the CMC.

The CMC to be used as the water soluble resin B is not particularly limited, and, for example, a CMC having an etherification degree of about 0.5 to 1.0 is preferable.

Specific examples of the CMC include the same CMC as used in the sublimation-type inkjet textile printing transfer paper I.

The silica particles that are the fine particles B described later are more porous than the inorganic fine particles having a tabular crystal structure that are the fine particles A. Thus, in consideration of the fact that powder falling from the paper surface easily occurs as compared to the inorganic fine particles having a tabular crystal structure, desirably, a CMC having a preferable molecular weight is selected as appropriate and used, and the amount thereof is adjusted to fall within, for example, a range described later.

When the CMC is used as the water soluble resin B, the amount of the CMC in the ink receiving layer coating material B in solid content is preferably 100 to 500 parts by mass and further preferably 150 to 350 parts by mass with respect to 100 parts by mass of the fine particles B. If the amount of the CMC is less than 100 parts by mass, the efficiency of transfer of the sublimation-type textile printing ink to the transfer target object may decrease, and a problem of strike-through of the sublimation-type textile printing ink in the sublimation-type inkjet textile printing transfer paper II may also arise. If the amount of the CMC exceeds 500 parts by mass, the dryability of the sublimation-type textile printing ink may decrease, and a problem of fouling such as offset of the sublimation-type textile printing ink at the time of storage may arise.

In the sublimation-type inkjet textile printing transfer paper II, a PVA can be used together with the CMC as the water soluble resin B. When the PVA is used, the type thereof is not particularly limited, and PVAs having various saponification degrees and various molecular weights can be used, but a PVA having a saponification degree of about 87 to 99 mol % and a number-average molecular weight of not greater than about 1000 is particularly preferable.

Specific examples of the PVA include the same PVA as used in the sublimation-type inkjet textile printing transfer paper I.

When the PVA is used together with the CMC as the water soluble resin B, the amount of the PVA in the ink receiving layer coating material B in solid content is preferably not greater than 200 parts by mass and further preferably not greater than 100 parts by mass with respect to 100 parts by mass of the fine particles B. By using the PVA in this range, both excellent dryability of the sublimation-type textile printing ink and high-level prevention of strike-through of the sublimation-type textile printing ink can be achieved. If the amount of the PVA exceeds 200 parts by mass, ink absorption of the fine particles is inhibited by the excessive PVA coating the surfaces of the fine particles B, which tends to decrease the dryability of the sublimation-type textile printing ink.

By using the CMC and the PVA in the above respective ranges as the water soluble resin B, both further excellent dryability of the sublimation-type textile printing ink and high-level prevention of strike-through of the sublimation-type textile printing ink can be achieved.

The fine particles B contained in the ink receiving layer coating material B are at least silica particles.

The silica particles are preferably porous synthetic amorphous silica particles having a large pore volume. Such synthetic amorphous silica particles are porous particles having an indefinite shape in which a three-dimensional structure of $SiO_2$ is formed by gelling of silicic acid, and have a pore size of about 10 to 2000 angstroms. Particularly, by using such synthetic amorphous silica particles, absorbency of the sublimation-type textile printing ink by the transfer target object is improved, and the transfer rate of the sublimation-type textile printing ink to the transfer target object is also improved, so that an image on the transfer target object can be made further clear.

As the synthetic amorphous silica particles, commercially available particles can be suitably used, and examples thereof include: MIZUKASIL P-526, MIZUKASIL P-801, MIZUKASIL NP-8, MIZUKASIL P-802, MIZUKASIL P-802Y, MIZUKASIL C-212, MIZUKASIL P-73, MIZUKASIL P-78A, MIZUKASIL P-78F, MIZUKASIL P-87, MIZUKASIL P-705, MIZUKASIL P-707, MIZUKASIL P-707D, MIZUKASIL P-709, MIZUKASIL C-402, and MIZUKASIL C-484 (manufactured by Mizusawa Industrial Chemicals, Ltd.); Tokusil U, Tokusil UR, Tokusil GU, Tokusil AL-1, Tokusil GU-N, Tokusil N, Tokusil NR, Tokusil PR, Solex, Finesil E-50, Finesil T-32, Finesil X-30, Finesil X-37, Finesil X-37B, Finesil X-45, Finesil X-60, Finesil X-70, Finesil RX-70, Finesil A, and Finesil B (manufactured by OSC Japan K.K.); SIPERNAT, CARPLEX FPS-101, CARPLEX CS-7, CARPLEX 80, CARPLEX 80D, and CARPLEX 67 (manufactured by DSL. Japan K.K.); SILYSIA 350 and SILYSIA 445 (manufactured by FUJI SILYSIA CHEMICAL LTD.); and NIPGEL AY-200, NIPGEL AY-6A3, NIPGEL AZ-200, NIPGEL AZ-6A0, NIPGEL BY-200, NIPGEL CX-200, NIPGEL CY-200, Nipsil E-150J, Nipsil E-220A, and Nipsil E-200A (manufactured by Tosoh Corporation).

The silica particles have an average particle diameter of preferably 2 to 20 μm and further preferably 4 to 16 μm. By using the fine silica particles having an average particle diameter of 2 to 20 μm as the fine particles B, higher-quality color reproducibility and image reproducibility can be achieved.

Furthermore, at least two types of silica particles having different average particle diameters are preferably used in combination, and silica particles having an average particle diameter of 2 to 5 μm and silica particles having an average particle diameter exceeding 5 μm are particularly preferably used in combination as the fine particles B. By using silica particles having different average particle diameters in combination as described above, the dryability of the sublimation-type textile printing ink can be further improved.

When at least two types of silica particles having different average particle diameters are used in combination, the ratio of silica particles having an average particle diameter of 2 to 5 μm and silica particles having an average particle diameter exceeding 5 μm (silica particles having an average particle diameter of 2 to 5 μm/silica particles having an average particle diameter exceeding 5 μm) is not particularly limited, but is preferably 10/90 to 50/50 as a solid content mass ratio. By setting such a ratio, more excellent dryability of the sublimation-type textile printing ink, more excellent reproducibility of an image on the sublimation-type inkjet textile printing transfer paper II, more excellent reproducibility of an image on the transfer target object, and higher efficiency of transfer of the sublimation-type textile printing ink are achieved.

The method for measuring the particle diameter of the fine particles B in the present disclosure is the same as the method in Embodiment I described above, except that a 50 μm or 200 μm aperture is used.

As long as the advantageous effects of the sublimation-type inkjet textile printing transfer paper II are achieved, it is possible to blend other fine particles together with the silica particles. Examples of the other fine particles include: inorganic pigments, such as precipitated calcium carbonate, heavy calcium carbonate, magnesium carbonate, magnesium hydroxide, kaolin, talc, calcium sulfate, barium sulfate, titanium dioxide, zinc oxide, zinc sulfide, zinc carbonate, satin white, aluminum silicate, diatom earth, calcium silicate, magnesium silicate, alumina, colloidal alumina, hydrated alumina (pseudo-boehmite), aluminium hydroxide, lithopone, zeolite, hydrated halloysite, and magnesium hydroxide; and organic pigments such as styrene-based plastic pigments, acrylic-based plastic pigments, polyethylene, microcapsule, urea resin, and melamine resin. One type of these fine particles can be used solely, or two or more types of these fine particles can be selected as appropriate and used.

The amount of the fine particles B contained in the ink receiving layer coating material B is preferably 12.5 to 50 parts by mass and more preferably 18 to 40 parts by mass with respect to 100 parts by mass of the ink receiving layer coating material B. If the amount of the fine particles B is less than 12.5 parts by mass, the amount of the sublimation-type textile printing ink received decreases, so that the ink dryability tends to decrease, and fouling due to rubbing of the ink may occur, or a problem of cockling (waves of paper occurring from shrinkage of the paper by absorption of the ink) may arise when the ink reaches a base paper layer. On the other hand, if the amount of the fine particles B exceeds 50 parts by mass, the amount of the sublimation-type textile printing ink received increases, but the efficiency of sublimation at the time of transfer tends to decrease, and a problem of insufficiency of the density of a transferred image may arise.

The method for preparing the ink receiving layer coating material B is not particularly limited, but, for example, a method in which a coating material can be made while a state where the fine particles B are dispersed is maintained, by adding the water soluble resin B such as the CMC and the PVA to a fine particles B-dispersed slurry, and mixing and dispersing are performed at about 20 to 45° C., can be adopted.

The solid content concentration of the ink receiving layer coating material B obtained as described above is not particularly limited. Because of the characteristics of the CMC that is a principal component, in order to form a continuous coating, preferably, the solid content concentration is higher, the viscosity is higher, and the molecular weight is higher. However, if the solid content concentration is excessively high, the viscosity of the mixed coating material increases, which contradicts the application workability. Thus, practically, the solid content concentration is preferably about 10 to 20%. If the solid content concentration of the ink receiving layer coating material B is less than 10%, the mixed coating material easily infiltrates into the base material, and it is necessary to increase the coating amount of the mixed coating material in order to obtain a continuous coating, but the amount of moisture involved in drying becomes excessively large, and drying wrinkles tend to occur. As a result, the appearance of the paper may deteriorate and heat transmission at the time of ink transfer may also become uneven due to paper wrinkles. If the solid content concentration of the ink receiving layer coating material B exceeds 20%, the viscosity of the mixed coating material increases, and it becomes difficult to control the coating amount of the mixed coating material by a normal coating method.

In the production method II for the transfer paper II according to the present disclosure, the ink receiving layer coating material A is prepared as described above, the ink receiving layer coating material B is separately prepared as described above, and the ink receiving layer coating material A and the ink receiving layer coating material B are mixed to prepare the mixed coating material.

Generally, with textile printing transfer paper obtained by increasing the amount of silica in an ink receiving layer coating material, the ink dryability improves at the time of inkjet printing, but the amount of the ink remaining on the textile printing transfer paper tends to increase at the time of transfer printing to a transfer target object. For example, with a coating material that is prepared by a method in which a clay slurry and a silica slurry are mixed and then a water soluble resin such as a CMC is added thereto as in a normal coating material preparing method, the ink dryability improves as the amount of silica increases, but the effect of decreasing the concentration of the ink remaining on a paper surface after sublimation transfer is significantly lost due to the ink blocking effect by the clay. That is, when the normal coating material preparing method is adopted, regarding the relationship between the ink dryability and the amount of the ink remaining, the ink dryability substantially is considered to linearly change in response to the ratio of the inorganic fine particles having a tabular crystal structure in the ink receiving layer coating material A and the silica particles in the ink receiving layer coating material B, but the effect of decreasing the amount of the ink remaining is thought to be lost earlier.

Meanwhile, when the ink receiving layer coating material A and the ink receiving layer coating material B are mixed to prepare the mixed coating material as in the production method II for the transfer paper II, the ink dryability linearly changes in response to the proportion of the silica particles in the ink receiving layer coating material B, but the amount of the ink remaining on the sublimation-type inkjet textile printing transfer paper II shifts in a direction in which the amount of the ink remaining is decreased, that is, in a direction in which the transfer density is increased. That is, it is thought that whereas the silica particles contained in the ink receiving layer coating material B improve the ink dryability, the effect of decreasing the amount of the ink remaining by the inorganic fine particles having a tabular crystal structure that are contained in the ink receiving layer coating material A considerably remains. The reason for exhibition of such an effect is not clear. However, it is thought that, by separately preparing the coating materials, the inorganic fine particles having a tabular crystal structure in the ink receiving layer coating material A and the silica particles in the ink receiving layer coating material B are present in the respective coating materials in a state where their respective functions are easily performed, but, on the other hand, in the normal coating material preparing method, the silica particles easily perform their function but a state where the function of the inorganic fine particles having a tabular crystal structure is less likely to be performed is caused. Therefore, it is thought that in the production method II for the transfer paper II, the relationship between the ink dryability and the amount of the ink remaining substantially linearly changes in response to the ratio of the inorganic fine particles having a tabular crystal structure in the ink receiving layer coating material A and the silica particles in the ink receiving layer coating material B, but in the normal coating material preparing method, the effect of reducing the amount of the ink remaining is significantly lost and such a relationship does not linearly change.

The ratio of the ink receiving layer coating material A and the ink receiving layer coating material B in the mixed coating material (ink receiving layer coating material A/ink receiving layer coating material B) is preferably 20/80 to 80/20 and further preferably 25/75 to 75/25 as a solid content mass ratio. If the ratio of both coating materials is less than 20/80, the characteristics of the ink receiving layer coating material A are not sufficiently exhibited, and the concentration of the ink remaining on the paper surface may become high. If the ratio of both coating materials exceeds 80/20, the characteristics of the ink receiving layer coating material B are less likely to be exhibited, and the effect of improving the ink dryability may become insufficient.

The method for preparing the mixed coating material is not particularly limited, but, for example, a method in which the ink receiving layer coating material A and the ink receiving layer coating material B that are separately prepared by the above methods are adjusted such that the ratio of both coating materials falls within, for example, the above range, and are uniformly agitated and mixed at about 20 to 45° C., can be adopted.

The solid content concentration of the mixed coating material is also not particularly limited, but is preferably, for example, about 10 to 22% from the standpoint that the coating amount of the mixed coating material by a normal coating method is easily controlled.

The sublimation-type inkjet textile printing transfer paper II can be produced by applying the mixed coating material to the base material to form the sublimation-type textile printing ink receiving layer on the base material.

The method for applying the mixed coating material is not particularly limited, but in order to efficiently achieve the advantageous effects of the sublimation-type inkjet textile printing transfer paper II, the mixed coating material prepared as described above can be applied, for example, in the same manner as when the sublimation-type inkjet textile printing transfer paper I is produced. Particularly, an air knife coater is preferably used in terms of inhibition of streak occurrence due to presence of the fine particles A and the fine particles B serving as a filler and formation of a uniform sublimation-type textile printing ink receiving layer by contour application to the paper surface.

The coating amount (dry) of the mixed coating material is in a range of 2 to 12 g/m$^2$ and preferably in a range of 3 to 10 g/m$^2$. The silica particles that are the fine particles B are contained in the mixed coating material together with the inorganic fine particles having a tabular crystal structure that are the fine particles A, the silica particles are bulkier than the inorganic fine particles having a tabular crystal structure, which are typified by delaminated clay and secondary clay having hydrophilicity, and thus the quality of the sublimation-type inkjet textile printing transfer paper II can be improved in a smaller coating amount. If the coating amount of the mixed coating material is less than 2 g/m$^2$, cockling (waving) due to soaking of the sublimation-type textile printing ink into the base material occurs, or it is difficult to fully coat the base material with the mixed coating material, coating defects such as fine uncoated portions, that is, pinholes, occur, and the image reproducibility decreases. If the coating amount of the mixed coating material exceeds 12 g/m$^2$, printing and transfer quality of the sublimation-type textile printing ink improves by an increase in the coating amount, but a curl or unevenness of the transfer surface occurs due to the difference in the degree of dimensional change due to shrinkage of the paper between the sublimation-type textile printing ink receiving layer and the base material, during heat transmission at the time of thermal transfer. Thus, the adhesion between the fabric and the paper becomes ununiform, which becomes a factor for occurrence of transfer density unevenness. In addition, a partial difference in coating amount becomes great, and thus the image reproducibility decreases.

The sublimation-type inkjet textile printing transfer paper II is sublimation-type inkjet textile printing transfer paper in which, as described above, the sublimation-type textile printing ink receiving layer is formed on the base material. Among these, sublimation-type inkjet textile printing transfer paper, in which the base material is made from pulp containing broad-leaved tree kraft pulp as a principal component, the sublimation-type textile printing ink receiving layer is formed on one surface of the base material, a resin composition that contains a water soluble resin and does not contain a filler is applied to the other surface of the base material such that the solid content amount of the water soluble resin is 0.15 to 3.5 g/m$^2$, and the viscosity, at 30° C., of a 15% solution of the CMC that is contained in the sublimation-type textile printing ink receiving layer is 0.15 to 6 Pa·s, particularly considerably achieves the effects as the sublimation-type inkjet textile printing transfer paper II.

The resin composition applied to the surface (back surface) of the base material on which the sublimation-type textile printing ink receiving layer is not formed contains a water soluble resin that is the same as the water soluble resin A and the water soluble resin B used when the sublimation-type textile printing ink receiving layer is formed, but does not contain a filler such as the fine particles A and the fine particles B. Thus, an effect that a coating is easily formed by the water soluble resin in a small coating amount is particularly achieved. The coating of the water soluble resin on the back surface prevents a curl at the time of printing and transfer and also has an effect of preventing fouling of a facility at the time of printing and transfer due to passing of the sublimation-type textile printing ink to the back surface.

The resin composition is preferably applied such that the solid content amount of the water soluble resin is preferably 0.15 to 3.5 g/m$^2$ and further preferably 0.3 to 2.5 g/m$^2$. Accordingly, the effect of preventing fouling of the facility at the time of printing and transfer due to passing of the ink to the back surface is sufficiently exhibited by the formation of the coating of the water soluble resin. By preventing the coating amount from being excessively large, the paper is not made harder than necessary, tendency of occurrence of unevenness of the paper surface or wrinkles from strain due to shrinkage of the paper at the time of thermal transfer is prevented, and occurrence of transfer density unevenness can be inhibited.

In addition, regarding the CMC that is the water soluble resin A and the water soluble resin B contained in the sublimation-type textile printing ink receiving layer, the viscosity, at 30° C., of a 15% solution of the CMC is preferably 0.15 to 6 Pa·s and further preferably 0.2 to 5 Pa's. Accordingly, a phenomenon that the coating film of the sublimation-type textile printing ink receiving layer is torn due to a low viscosity of the CMC is not caused, and a defect does not occur in the continuous coating. On the other hand, the following can also be avoided: coating becomes difficult due to an excessively high viscosity of the CMC, a drying load is applied when the solid content is reduced for decreasing the viscosity, and film formation may be adversely affected when the CMC is kept at a high temperature for a long period of time for decreasing the viscosity.

Furthermore, when an under layer is formed between the sublimation-type textile printing ink receiving layer and the base material in the sublimation-type inkjet textile printing transfer paper II, and contains the CMC that is the principal component of the sublimation-type textile printing ink receiving layer, the sublimation-type inkjet textile printing transfer paper II achieves particularly significant effects.

The advantageous effects achieved when an under layer containing CMC is formed between the sublimation-type textile printing ink receiving layer and the base material, and the amount of the CMC contained in the under layer, a component that may be contained in an under layer coating material for forming the under layer, etc. are the same as those in the sublimation-type inkjet textile printing transfer paper I.

As described above, in the sublimation-type inkjet textile printing transfer paper II, the sublimation-type textile printing ink receiving layer is formed on the base material having a specific water absorption from the mixed coating material of: the coating material that contains the CMC, which is the water soluble resin, and the inorganic fine particles having a tabular crystal structure, which are the filler, in a specific ratio and that can make the number of pinhole appearance very small; and the coating material containing the CMC, which is the water soluble resin, and the silica particles, which are the filler. Thus, the sublimation-type inkjet textile printing transfer paper II is excellent in the dryability of the sublimation-type textile printing ink at the time of inkjet printing, and has a small amount of the sublimation-type textile printing ink remaining thereon and is also excellent in the efficiency of transfer onto a transfer target object, such as the reproducibility of an image, the resolution of a transferred image, the density level of the transferred image, and the uniformity of these, at the time of transfer printing onto the transfer target object.

Embodiment III: Sublimation-Type Inkjet Textile Printing Transfer Paper III and Production Method III for Transfer Paper III The sublimation-type inkjet textile printing transfer paper III according to the present disclosure is sublimation-type inkjet textile printing transfer paper in which a sublimation-type textile printing ink receiving layer is formed on a base material. The sublimation-type textile printing ink receiving layer is made from an ink receiving layer coating material containing at least a water soluble resin, fine particles A, and fine particles B.

The type of the base material used in the sublimation-type inkjet textile printing transfer paper III, for example, the type, the characteristics, and the like of a suitably used base material such as kraft paper, may be the same as those in the base material in the sublimation-type inkjet textile printing transfer paper I.

Similarly to the base material in the sublimation-type inkjet textile printing transfer paper I, the base material used in the sublimation-type inkjet textile printing transfer paper III also has a basis weight of preferably 50 to 140 g/m$^2$ and more preferably 55 to 110 g/m$^2$.

Similarly to the base material in the sublimation-type inkjet textile printing transfer paper I, the coating surface of the ink receiving layer coating material on the base material used in the sublimation-type inkjet textile printing transfer paper III also has a Bekk smoothness, conforming to JIS P 8119, of preferably 30 to 400 seconds and more preferably 50 to 300 seconds.

Similarly to the base material in the sublimation-type inkjet textile printing transfer paper I, also in the base material used in the sublimation-type inkjet textile printing transfer paper III, various chemical additives can be blended, and various fillers can be further blended in an adjustable range.

Similarly to the base material in the sublimation-type inkjet textile printing transfer paper I, the base material used in the sublimation-type inkjet textile printing transfer paper III also has a 10-second Cobb water absorption, conforming to JIS P 8140, of 5 to 20 g/m$^2$ and preferably 10 to 16 g/m$^2$.

In the sublimation-type inkjet textile printing transfer paper m, the sublimation-type textile printing ink receiving layer is made from the ink receiving layer coating material containing at least the water soluble resin, the fine particles A, and the fine particles B and is formed on the base material.

The water soluble resin is used mainly as a binder in a normal coating material. However, in the present disclosure, the water soluble resin is at least a CMC since the CMC has a characteristic of trapping and absorbing the sublimation-type textile printing ink, but compounds other than the CMC can be used. Examples of the compounds other than the CMC include the water-soluble natural polymer compounds and the water-soluble synthetic polymer compounds that can be used in the sublimation-type inkjet textile printing transfer paper I. One or more compounds can be selected from these compounds and used together with the CMC.

In order to make the sublimation-type textile printing ink receiving layer exhibit performance of rapidly absorbing/ drying the sublimation-type textile printing ink, which is a feature of the sublimation-type inkjet textile printing transfer paper III according to the present disclosure, at least the CMC is used as the water soluble resin. However, the polymerization degree or the molecular weight of the CMC is also considered to influence this performance, and thus, preferably, a CMC having a predetermined polymerization degree and a predetermined molecular weight is used, and the temperature is controlled at the time of application of the ink receiving layer coating material.

Similarly to the CMC used in the sublimation-type inkjet textile printing transfer paper I, examples of a suitably used CMC include a CMC having a polymerization degree of 30 to 180 and a weight-average molecular weight of 6600 to 40000. The CMC having a polymerization degree of 30 to 180 and a weight-average molecular weight of 6600 to 40000 allows a sublimation-type textile printing ink receiving layer having less coating defect to be easily formed in terms of viscosity and workability, and also can make application of the ink receiving layer coating material easy.

In addition, for example, a CMC having an etherification degree of about 0.5 to 1.0 can be used.

Specific examples of the CMC include the same CMC as used in the sublimation-type inkjet textile printing transfer paper I.

In the sublimation-type inkjet textile printing transfer paper III, a PVA can be used together with the CMC as the water soluble resin. A preferable PVA and its effect are the same as those in the sublimation-type inkjet textile printing transfer paper II.

In addition, as described later, when the amount of the CMC becomes excessively large with respect to the fine particles A and the fine particles B, the CMC coats these fine particles, and transfer unevenness easily occurs at the time of transfer printing on a transfer target object, but the amount of the CMC can be reduced as appropriate by using the PVA together with the CMC as the water soluble resin.

Specific examples of the PVA include the same PVA as used in the sublimation-type inkjet textile printing transfer paper I.

The fine particles A contained in the ink receiving layer coating material are at least inorganic fine particles having a tabular crystal structure.

In the ink receiving layer coating material, the inorganic fine particles having a tabular crystal structure are contained as a filler in combination with the water soluble resin. Thus, the absorbability and dryability of the sublimation-type textile printing ink at the time of printing significantly improves, for example, due to the synergistic effect with a penetrant contained in the base material, and the sublimation-type inkjet textile printing transfer paper II can achieve excellent characteristics in terms of image reproducibility, heat resistance at the time of heating transfer, image reproducibility on the surface of a transfer target object after transfer, and transfer efficiency.

As the inorganic fine particles having a tabular crystal structure, for example, delaminated clay or secondary clay having hydrophilicity is suitably used. By using inorganic fine particles having a median diameter d50 in a range of 0.4 to 2.3 μm and preferably in a range of 0.4 to 1.4 μm and having an aspect ratio of not less than 5 and preferably 8 to 80, an ink barrier layer can be formed by the inorganic fine particles without inhibiting formation of a continuous coating of the CMC. With inorganic fine particles having a median diameter of less than 0.4 μm and an aspect ratio of less than 5, a sufficient ink barrier layer cannot be formed. With inorganic fine particles having a median diameter exceeding 2.3 μm, sedimentation of the fine particles easily occur in the ink receiving layer coating material, handleability such as feedability of the coating material decreases, and quality stabilization is inhibited. With inorganic fine particles having an aspect ratio exceeding 80, the concentration of the ink receiving layer coating material decreases due to a decrease in the dispersion concentration of the particles, and drying wrinkles tend to easily occur since a larger amount of moisture is taken out after application. In order to prevent this, the amount of the inorganic fine particles to be used may be limited more.

In Embodiment III, since the inorganic fine particles having a tabular crystal structure that are the fine particles A and silica particles that are the fine particles B described later are present together in the ink receiving layer coating material, inorganic fine particles that have a relatively high aspect ratio and have a tabular crystal structure can be used. In an ink receiving layer coating material that does not contain silica particles, the effect of blocking ink by inorganic fine particles having a tabular crystal structure is excessively great, and thus the ink dryability may considerably decrease. However, when silica particles are blended, ink absorbency is imparted by the silica particles, and excess of the effect of blocking ink by the inorganic fine particles having a tabular crystal structure does not have to be taken into consideration much.

The fine particles B contained in the ink receiving layer coating material are at least silica particles.

The type of the silica particles used in the sublimation-type inkjet textile printing transfer paper III, for example, the type, the characteristics, and the like of suitably used silica particles such as synthetic amorphous silica particles, may be the same as those of the silica particles in the sublimation-type inkjet textile printing transfer paper II.

Similarly to the silica particles in the sublimation-type inkjet textile printing transfer paper II, the silica particles used in the sublimation-type inkjet textile printing transfer paper III also have an average particle diameter of preferably 2 to 20 μm and further preferably 4 to 16 μm.

Furthermore, at least two types of silica particles having different average particle diameters are preferably used in combination similarly to the sublimation-type inkjet textile printing transfer paper II, and the advantageous effects achieved thus are the same as those in the sublimation-type inkjet textile printing transfer paper II. Silica particles having an average particle diameter of 2 to 5 μm and silica particles having an average particle diameter exceeding 5 μm are particularly preferably used in combination as the fine particles B such that the ratio thereof (silica particles having an average particle diameter of 2 to 5 μm/silica particles having an average particle diameter exceeding 5 μm) is 10/90 to 50/50 as a solid content mass ratio.

As long as the advantageous effects of the sublimation-type inkjet textile printing transfer paper III are achieved, it is possible to blend other fine particles together with the inorganic fine particles having a tabular crystal structure that are the fine particles A and the silica particles that are the fine particles B. Examples of the other fine particles include the fine particles that can be blended together with the inorganic fine particles having a tabular crystal structure in Embodiment TI.

The ratio of the fine particles A and the fine particles B in the ink receiving layer coating material (fine particles A/fine particles B) is 15/85 to 90/10, preferably 15/85 to 85/15, and further preferably 20/80 to 80/20 as a mass ratio. If the ratio of both fine particles is less than 15/85, the characteristics of the fine particles A are not sufficiently exhibited, the concentration of the ink remaining on the paper surface increases, and the reproducibility of an image decreases. If the ratio of both fine particles exceeds 90/10, the characteristics of the fine particles B are not sufficiently exhibited, the effect of improving the ink dryability becomes insufficient, and density unevenness occurs in an image.

The amount of the CMC in the ink receiving layer coating material in solid content is not less than the sum of 50 parts by mass with respect to 100 parts by mass of the fine particles A and 120 parts by mass with respect to 100 parts by mass of the fine particles B, and preferably not less than the sum of 60 parts by mass with respect to 100 parts by mass of the fine particles A and 140 parts by mass with respect to 100 parts by mass of the fine particles B, and is not greater than 400 parts by mass and preferably not greater than 360 parts by mass with respect to 100 parts by mass in total of the fine particles A and the fine particles B. If the amount of the CMC is less than the above sum, the surface strength of the sublimation-type textile printing ink receiving layer becomes insufficient, powder falling from the paper surface occurs due to peeling of the ink receiving layer, and the density level of a transferred image decreases at the time of transfer printing on a transfer target object. If the amount of the CMC exceeds 400 parts by mass, the fine particles A and the fine particles B are coated with the CMC, the characteristics of these fine particles are not sufficiently exhibited, and transfer unevenness occurs at the time of transfer printing on a transfer target object.

The reason why 50 parts by mass and preferably 60 parts by mass are set with respect to 100 parts by mass of the fine particles A when the lower limit of the amount of the CMC in the ink receiving layer coating material is determined is that: if the amount of the CMC is less than 50 parts by mass, the absorbability and dryability of the sublimation-type textile printing ink only with the CMC is not sufficient, and use of the CMC in combination with fine particles having high ink absorbability is required; and the fact that the CMC serving as a binder is absorbed by the base material and lost due to the concentration of the ink receiving layer coating material being low is taken into consideration. In addition, the reason why 120 parts by mass and preferably 140 parts by mass are set with respect to 100 parts by mass of the fine particles B is that if the amount of the CMC is less than 120 parts by mass, the efficiency of transfer of the sublimation-type textile printing ink to a transfer target object decreases, and a problem of strike-through of the sublimation-type textile printing ink in the sublimation-type inkjet textile printing transfer paper III arises. In addition, since the silica particles that are the fine particles B are more porous than the inorganic fine particle having a tabular crystal structure that are the fine particles A, the fact that powder falling from the paper surface easily occurs as compared to the inorganic fine particles having a tabular crystal structure is taken into consideration.

When the PVA is used together with the CMC as the water soluble resin, the amount of the PVA in the ink receiving layer coating material in solid content is preferably not greater than 80 parts by mass and further preferably not greater than 50 parts by mass with respect to 100 parts by mass in total of the fine particles A and the fine particles B. By adjusting the amount of the PVA within this range, more excellent absorbability and dryability of the sublimation-type textile printing ink can be achieved. If the amount of the PVA exceeds 80 parts by mass, a sign that film formation by the PVA hinders film formation by the CMC may appear, and a coating defect may be induced.

In the production method III for the transfer paper III according to the present disclosure, first, a high-density dispersion of the fine particles A is prepared, then the fine particles B are immediately added to a diluted dispersion obtained by diluting the high-density dispersion, to prepare a mixed dispersion slurry of the fine particles A and the fine particles B, and the water soluble resin is added to the slurry to prepare the ink receiving layer coating material.

If the inorganic fine particles having a tabular crystal structure that are the fine particles A are dispersed in a low concentration, an aggregate state of the inorganic fine particles having a tabular crystal structure cannot be fully broken, the inorganic fine particles having a tabular crystal structure are not brought into a fine state, and thus the effect of blocking the sublimation-type textile printing ink decreases. Therefore, in the production method III for the transfer paper III, a dispersion obtained by dispersing the inorganic fine particles having a tabular crystal structure in a high concentration such that the aggregate state of the inorganic fmc particles having a tabular crystal structure is fully broken and the inorganic fine particles having a tabular crystal structure is brought into a fine state, is diluted. Then, the amount of the fine particles B to be added is set such that a mixed dispersion slurry obtained by adding the silica particles, which are the fine particles B, to the diluted dispersion can also maintain a high-concentration dispersion state.

In order to prepare the high-density dispersion of the fine particles A, for example, water is used as a solvent, a dispersant, such as sodium polyacrylate or polyphosphates such as sodium pyrophosphate, is added in an adequate amount in accordance with the characteristics of the fine particles A, and the fine particles A are added and dispersed such that the ratio of the solvent and the fine particles A (solvent/fine particles A) is preferably about 20/80 to 45/55 and further preferably 25/75 to 40/60 as a mass ratio. For dispersing the fine particles A, for example, a normal high-speed impeller type dispersion machine can be used, and a high-density dispersion having a fine particles A concentration of preferably about 55 to 80% and further preferably about 60 to 75% is obtained with a wet-mixing dispersion machine such as a Cowles dispersion machine, a high-speed mixer, a Kady mill, a speed mill, and a homogenizer.

Next, the solvent is added to the high-density dispersion in a predetermined ratio to dilute the high-density dispersion, and the fine particles B are immediately added to the obtained diluted dispersion. Then, the fine particles B are dispersed with the same dispersion machine as used for dispersing the fine particles A, to prepare the mixed dispersion slurry of the fine particles A and the fine particles B. At this time, a dispersant suitable for dispersing the fine particles B in a high concentration is preferably added in an adequate amount in accordance with the characteristics of the fine particles B.

In the mixed dispersion slurry prepared as described above, the ratio of the concentration of the fine particles A and the concentration of the fine particles B (concentration of fine particles A/concentration of fine particles B), that is, the ratio of the fine particles A and the fine particles B in the ink receiving layer coating material, is 15/85 to 90/10, preferably 15/85 to 85/15, and further preferably 20/80 to 80/20, and the mixed concentration of the fine particles A and the fine particles B in the mixed dispersion slurry is preferably about 20 to 52%.

In the mixed dispersion slurry obtained by mixing and dispersing the fine particles A and the fine particles B according to the production method III for the transfer paper III, particle sedimentation becomes slower than in a slurry of the fine particles B solely, and a risk of clogging is reduced when, for example, filtration for eliminating foreign matter is performed in a feeding pipe or with a mesh, so that there is an advantage that the handleability improves. In addition to this advantage, when a high-concentration dispersion slurry of the fine particles A, which are inorganic fine particles having a tabular crystal structure, and a high-concentration dispersion slurry of the fine particles B, which are silica particles, are prepared, mixed, and used as in a conventional method, residual liquids of both dispersion slurries occur, but when the mixed dispersion slurry is prepared according to the production method III for the transfer paper III, a residue of the fine particles A, which are relatively cheap, occurs, but a residue of the fine particles B, which are relatively expensive, does not occur, so that there is also an advantage that cost reduction can be sufficiently achieved.

Next, by adding the water soluble resin to the mixed dispersion slurry, a coating material can be made while a state where the fine particles A and the fine particles B are dispersed is maintained, and the ink receiving layer coating material is prepared by mixing at 20 to 45° C.

When the ink receiving layer coating material A is prepared by using the CMC and the PVA in combination as the water soluble resin, the PVA is preferably added to the mixed dispersion slurry earlier than the CMC, from the standpoint that an effect of further reducing coating defects is achieved. The reason for this is not clear, but it is thought that inhibition of film formation by the CMC more easily occurs as the amount of the free PVA is larger, and by bringing the PVA into contact with the fine particles earlier than the CMC, the amount of the PVA trapped by the fine particles becomes larger, so that inhibition of film formation by the CMC is reduced.

The solid content concentration of the ink receiving layer coating material obtained as described above is not particularly limited. Because of the characteristics of the CMC that is a principal component, in order to form a continuous coating, preferably, the solid content concentration is higher, the viscosity is higher, and the molecular weight is higher. However, if the solid content concentration is excessively high, the viscosity of the ink receiving layer coating material increases, which contradicts the application workability. Thus, practically, the solid content concentration is preferably about 10 to 22%. If the solid content concentration of the ink receiving layer coating material is less than 10%, the ink receiving layer coating material easily infiltrates into the base material, and it is necessary to increase the coating amount of the ink receiving layer coating material in order to obtain a continuous coating, but the amount of moisture involved in drying becomes excessively large, and drying wrinkles tend to occur. As a result, the appearance of the paper may deteriorate and heat transmission at the time of ink transfer may also become uneven due to paper wrinkles. If the solid content concentration of the ink receiving layer coating material exceeds 22%, the viscosity of the ink receiving layer coating material increases, and it becomes difficult to control the coating amount of the ink receiving layer coating material by a normal coating method.

The sublimation-type inkjet textile printing transfer paper III can be produced by applying the ink receiving layer coating material to the base material to form the sublimation-type textile printing ink receiving layer on the base material.

The method for applying the ink receiving layer coating material is not particularly limited, but in order to efficiently achieve the advantageous effects of the sublimation-type inkjet textile printing transfer paper III, the ink receiving layer coating material prepared as described above can be applied, for example, in the same manner as when the sublimation-type inkjet textile printing transfer paper I is produced. Particularly, an air knife coater is preferably used in terms of inhibition of streak occurrence due to presence of the fine particles A and the fine particles B serving as a filler and formation of a uniform sublimation-type textile printing ink receiving layer by contour application to the paper surface.

The coating amount (dry) of the ink receiving layer coating material is in a range of 2 to 12 g/m$^2$ and preferably in a range of 3 to 10 g/m$^2$. The silica particles that are the fine particles B are contained in the ink receiving layer coating material together with the inorganic fine particles having a tabular crystal structure that are the fine particles A, the silica particles are bulkier than the inorganic fine particles having a tabular crystal structure, which are typified by delaminated clay and secondary clay having hydrophilicity, and thus the quality of the sublimation-type inkjet textile printing transfer paper III can be improved in a smaller coating amount. If the coating amount of the ink receiving layer coating material is less than 2 g/m$^2$, cockling (waving) due to soaking of the sublimation-type textile printing ink into the base material occurs, or it is difficult to fully coat the base material with the ink receiving layer coating material, and coating defects such as fine uncoated portions, that is, pinholes, occur. When the sublimation-type textile printing ink infiltrates through these portions to the base material, the sublimation-type textile printing ink is more unlikely to sublimate due to the sublimation-type textile printing ink receiving layer, and thus the reproducibility of an image such as occurrence of voids in a transferred image decreases. If the coating amount of the ink receiving layer coating material exceeds 12 g/m$^2$, printing and transfer quality of the sublimation-type textile printing ink improves by an increase in the coating amount, but a curl or unevenness of the transfer surface occurs due to the difference in the degree of dimensional change due to shrinkage of the paper between the sublimation-type textile printing ink receiving layer and the base material, during heat transmission at the time of thermal transfer. Thus, the adhesion between the fabric and the paper becomes ununiform, which becomes a factor for occurrence of transfer density unevenness. In addition, a partial difference in coating amount becomes great, and thus the image reproducibility decreases.

The sublimation-type inkjet textile printing transfer paper III is sublimation-type inkjet textile printing transfer paper in which, as described above, the sublimation-type textile printing ink receiving layer is formed on the base material. Among these, sublimation-type inkjet textile printing transfer paper in which the base material is made from pulp containing broad-leaved tree kraft pulp as a principal component, the sublimation-type textile printing ink receiving layer is formed on one surface of the base material, a resin composition that contains a water soluble resin and does not contain a filler is applied to the other surface of the base material such that the solid content amount of the water soluble resin is 0.15 to 3.5 g/m$^2$, and the viscosity, at 30° C., of a 15% solution of the CMC that is contained in the sublimation-type textile printing ink receiving layer is 0.15 to 6 Pa·s, particularly considerably achieves the effects as the sublimation-type inkjet textile printing transfer paper III.

The resin composition applied to the surface (back surface) of the base material on which the sublimation-type textile printing ink receiving layer is not formed contains a water soluble resin that is the same as the water soluble resin used when the sublimation-type textile printing ink receiving layer is formed, but does not contain a filler such as the fine particles A and the fine particles B. The advantageous effects achieved thereby are the same as those in the sublimation-type inkjet textile printing transfer paper II.

Similarly to the sublimation-type inkjet textile printing transfer paper II, the resin composition is preferably applied such that the solid content amount of the water soluble resin is preferably 0.15 to 3.5 g/m$^2$ and further preferably 0.3 to 2.5 g/m$^2$. The advantageous effects achieved thereby are the same as those in the sublimation-type inkjet textile printing transfer paper II.

In addition, regarding the CMC that is the water soluble resin contained in the sublimation-type textile printing ink receiving layer, similarly to the sublimation-type inkjet textile printing transfer paper II, the viscosity, at 30° C., of a 15% solution of the CMC is preferably 0.15 to 6 Pa·s and further preferably 0.2 to 5 Pa·s. The advantageous effects achieved thereby are the same as those in the sublimation-type inkjet textile printing transfer paper II.

Furthermore, when an under layer is formed between the sublimation-type textile printing ink receiving layer and the base material in the sublimation-type inkjet textile printing transfer paper III, and contains the CMC that is the principal component of the sublimation-type textile printing ink receiving layer, the sublimation-type inkjet textile printing transfer paper III achieves particularly significant effects.

The advantageous effects achieved when an under layer containing CMC is formed between the sublimation-type textile printing ink receiving layer and the base material, and the amount of the CMC contained in the under layer, a component that may be contained in an under layer coating material for forming the under layer, etc. are the same as those in the sublimation-type inkjet textile printing transfer paper I.

As described above, in the sublimation-type inkjet textile printing transfer paper III, the sublimation-type textile printing ink receiving layer is formed on the base material having a specific water absorption from the ink receiving layer coating material that contains the CMC, which is the water soluble resin, the inorganic fine particles having a tabular crystal structure, which are the filler, and the silica particles, which are the filler, in a specific ratio.

The CMC serves as an adhesive for the inorganic fine particles having a tabular crystal structure and the silica particles and exerts an effect of blocking pinholes and an effect of trapping the sublimation-type textile printing ink by swelling of the CMC itself. The inorganic fine particles having a tabular crystal structure reduce the sublimation-type textile printing ink remaining on the paper, by an effect of blocking infiltration of the sublimation-type textile printing ink, thereby exerting an effect of improving the density of a transferred image. On the other hand, since the inorganic fine particles having a tabular crystal structure do not contribute to the ink dryability, and blocks infiltration of the sublimation-type textile printing ink, the speed of sublimation transfer by heat increases, and a density difference of a transferred image may be produced if an uneven portion occurs when a hot plate and the sublimation-type inkjet textile printing transfer paper III are brought into close contact with each other. The silica particles have a high effect of trapping the sublimation-type textile printing ink, and inhibit a density difference of transfer density produced due to ununiform transmission of heat, by improving the ink dryability and decreasing the speed of sublimation transfer. On the other hand, the silica particles may cause the sublimation-type textile printing ink to remain on the paper and also cause a decrease in the density of a transferred image. Therefore, in the ink receiving layer coating material used in the sublimation-type inkjet textile printing transfer paper III, the CMC, the inorganic fine particles having a tabular crystal structure, and the silica particles are blended in a specific ratio such that the effect of each of these three components is sufficiently exerted.

Thus, the sublimation-type inkjet textile printing transfer paper III is excellent in the dryability of the sublimation-type textile printing ink at the time of inkjet printing, that causes less powder falling from a paper surface due to peeling of the ink receiving layer, and that has a small amount of the sublimation-type textile printing ink remaining thereon at the time of transfer printing onto a transfer target object. In addition, the sublimation-type inkjet textile printing transfer paper III can make it difficult to cause influence of slight variations in the manner of heat transmission at a sublimation transfer machine on a transferred image by appropriately decreasing the speed of sublimation transfer of the sublimation-type textile printing ink, and is also excellent in the efficiency of transfer onto a transfer target object, such as the reproducibility of an image, the resolution of a transferred image, the density level of the transferred image, and the uniformity of these.

Next, the sublimation-type inkjet textile printing transfer paper and the production method therefor according to the present disclosure will be described in more detail by means of the following examples, but the present disclosure is not limited only to these examples. The number of parts in a composition refers to the number of parts of a solid content.

Example I

The components used in each production example, each preparation example, each example, and each comparative example are as follow.

(1) Kraft Pulp

LBKP

Broad-Leaved Tree Bleached Kraft Pulp

Freeness (CSF) conforming to JIS P 8121-2: 530 ml

NBKP

Needle-Leaved Tree Bleached Kraft Pulp

Freeness (CSF) conforming to JIS P 8121-2: 580 ml (2) Water Soluble Resin

CMC-A1

CELLOGEN 5A (manufactured by DKS Co. Ltd.)

CMC-A2

FINNFIX 2 (manufactured by CP Kelco)

PVA-A

Kuraray Poval PVA 105 (manufactured by Kuraray Co., Ltd., saponification degree: 98 to 99 mol %, polymerization degree: 500)

(3) Fine Particles

Particle-A1

Inorganic Fine Particles Having a Tabular Crystal Structure

Secondary clay (median diameter d50: 0.7 μm, aspect ratio: 8)

Particle-A2

Inorganic Fine Particles Having a Tabular Crystal Structure

Delaminated clay (median diameter d50: 1.4 μm, aspect ratio: 20)

Particle-A3

Inorganic Fine Particles Having a Tabular Crystal Structure

Secondary clay (median diameter d50: 0.4 μm, aspect ratio: 8)

Particle-4

Inorganic Fine Particles Having a Tabular Crystal Structure

Secondary clay (median diameter d50: 0.2 μm, aspect ratio: 8)

Particle-5

Inorganic Fine Particles Having a Tabular Crystal Structure

Secondary clay (median diameter d50: 2.5 μm, aspect ratio: 8)

Particle-6

Inorganic Fine Particles Having a Tabular Crystal Structure

Secondary clay (median diameter d50: 0.7 μm, aspect ratio: 4)

Production Example I-1 (Production of Base Material)

A paper stock was prepared by blending 85% by mass of LBKP and 15% by mass of NBKP and adding 0.8 parts by mass of cationized starch, 1.1 parts by mass of an alkyl ketene dimer (internal sizing agent), and 0.3 parts by mass of anion-modified polyacrylamide as aids with respect to 100 parts by mass in total of kraft pulp. The paper stock was made into paper with a paper machine to produce kraft paper having a basis weight of 100 g/m$^2$, a Bekk smoothness, conforming to JIS P 8119, of 100 seconds, and a 10-second Cobb water absorption, conforming to JIS P 8140, of 10 g/m$^2$ (hereinafter, referred to as base material I-1).

Production Examples I-2 to I-4 (Production of Base Material)

Kraft paper (hereinafter, referred to as base materials I-2 to I-4) was produced in the same manner as Production Example I-1, except that the amount of the alkyl ketene dimer (internal sizing agent) was adjusted such that the 10-second Cobb water absorption of the kraft paper was a value shown in Table I-1. The basis weight and the Bekk smoothness of each kraft paper are shown in Table I-1.

TABLE I-1

| Production Example | Kraft pulp (mass %) LBKP | NBKP | Basis weight (g/m$^2$) | Bekk smoothness (sec) | 10-sec. Cobb water absorption (g/m$^2$) | Base material No. |
|---|---|---|---|---|---|---|
| I-1 | 85 | 15 | 100 | 100 | 10 | Base material I-1 |
| I-2 | 85 | 15 | 100 | 100 | 16 | Base material I-2 |
| I-3 | 85 | 15 | 100 | 100 | 4 | Base material I-3 |
| I-4 | 85 | 15 | 100 | 100 | 22 | Base material I-4 |

Preparation Example I-1 (Preparation of Ink Receiving Layer Coating Material)

Particle-A1 was used as the fine particles, and CMC-A1 was used as the water soluble resin in an amount of 200 parts by mass with respect to 100 parts by mass of Particle-A1. CMC-A1 was added and mixed into a dispersion slurry of Particle-A1 to prepare an ink receiving layer coating material having a solid content concentration of 18% (hereinafter, referred to as coating material I-1).

Preparation Examples I-2 to I-14 (Preparation of Ink Receiving Layer Coating Material)

Ink receiving layer coating materials having solid content concentrations shown in Table I-2 (hereinafter, referred to as coating materials I-2 to I-14, respectively) were prepared in the same manner as Preparation Example I-1, except that the composition was changed as shown in Table I-2. In Preparation Examples I-3 to I-5, PVA-A was added and mixed into a dispersion slurry of Particle-A1, and then CMC-A1 was added and mixed into the mixture to prepare an ink receiving layer coating material. In addition, the amount of the fine particles contained in each ink receiving layer coating material is also shown in Table I-2.

TABLE I-2

| Preparation Example | Water soluble resin (parts by mass) CMC-A1 | CMC-A2 | PVA-A | Fine particles (parts by mass) Particle-A1 | Particle-A2 | Particle-A3 | Particle-4 | Particle-5 | Particle-6 | Solid content concentration (%) | Contained amount of fine particles (parts by mass) | Coating material |
|---|---|---|---|---|---|---|---|---|---|---|---|---|
| I-1 | 200 | — | — | 100 | — | — | — | — | — | 18 | 33 | Coating material I-1 |
| I-2 | — | 200 | — | 100 | — | — | — | — | — | 18 | 33 | Coating material I-2 |
| I-3 | 200 | — | 30 | 100 | — | — | — | — | — | 18 | 30 | Coating material I-3 |
| I-4 | 200 | — | 15 | 100 | — | — | — | — | — | 18 | 32 | Coating material I-4 |
| I-5 | 200 | — | 8 | 100 | — | — | — | — | — | 18 | 32 | Coating material I-5 |
| I-6 | 150 | — | — | 100 | — | — | — | — | — | 18 | 40 | Coating material I-6 |
| I-7 | 300 | — | — | 100 | — | — | — | — | — | 18 | 25 | Coating material I-7 |
| I-8 | 200 | — | — | — | 100 | — | — | — | — | 18 | 33 | Coating material I-8 |
| I-9 | 200 | — | — | — | — | 100 | — | — | — | 18 | 33 | Coating material I-9 |
| I-10 | 200 | — | — | — | — | — | 100 | — | — | 18 | 33 | Coating material I-10 |
| I-11 | 80 | — | — | 100 | — | — | — | — | — | 18 | 56 | Coating material I-11 |
| I-12 | 420 | — | — | 100 | — | — | — | — | — | 17 | 19 | Coating material I-12 |
| I-13 | 200 | — | — | — | — | — | — | 100 | — | 18 | 33 | Coating material I-13 |
| I-14 | 200 | — | — | — | — | — | — | — | 100 | 18 | 33 | Coating material I-14 |

Example I-1 (Production of Sublimation-Type Inkjet Textile Printing Transfer Paper)

The coating material I-1 was applied to one surface of the base material I-1 with an air knife coater such that the coating amount (dry) thereof was 5 g/m$^2$, and the applied coating material I-1 was dried at about 130° C. to form a sublimation-type textile printing ink receiving layer, thereby producing sublimation-type inkjet textile printing transfer paper.

Examples I-2 to I-12 and Comparative Examples I-1 to I-9 (Production of Sublimation-Type Inkjet Textile Printing Transfer Paper)

Sublimation-type inkjet textile printing transfer paper was produced in the same manner as Example I-1, except that the types of the base material and the ink receiving layer coating material and the coating amount (dry) of the ink receiving layer coating material were changed as shown in Table I-3. In Examples I-3 and I-4, an under layer coating material was applied to one surface of the base material with an air knife coater in a coating amount (dry) shown in Table I-3 and dried at about 130° C. to form an under layer, and then the ink receiving layer coating material shown in Table I-3 was applied onto the under layer. As the under layer coating material, a coating material that is the same as the ink receiving layer coating material was used.

TABLE 3

Table I-3

| | Type of base material | Ink receiving layer coating material Type | Coating amount (g/m$^2$) | Coating amount of under layer coating material (g/m$^2$) |
|---|---|---|---|---|
| Example I-1 | Base material I-1 | Coating material I-1 | 5 | — |
| I-2 | Base material I-1 | Coating material I-1 | 10 | — |
| I-3 | Base material I-1 | Coating material I-1 | 3 | 3 |
| I-4 | Base material I-1 | Coating material I-1 | 4 | 6 |
| I-5 | Base material I-1 | Coating material I-2 | 10 | — |
| I-6 | Base material I-1 | Coating material I-4 | 10 | — |
| I-7 | Base material I-1 | Coating material I-5 | 10 | — |
| I-8 | Base material I-1 | Coating material I-6 | 10 | — |
| I-9 | Base material I-1 | Coating material I-7 | 10 | — |
| I-10 | Base material I-1 | Coating material I-8 | 10 | — |
| I-11 | Base material I-1 | Coating material I-9 | 10 | — |
| I-12 | Base material I-2 | Coating material I-1 | 10 | — |
| Comparative Example I-1 | Base material I-3 | Coating material I-2 | 10 | — |
| I-2 | Base material I-4 | Coating material I-3 | 10 | — |
| I-3 | Base material I-1 | Coating material I-10 | 10 | — |
| I-4 | Base material I-1 | Coating material I-11 | 10 | — |
| I-5 | Base material I-1 | Coating material I-12 | 10 | — |

TABLE 3-continued

Table I-3

| | Type of base material | Ink receiving layer coating material: Type | Ink receiving layer coating material: Coating amount ($g/m^2$) | Coating amount of under layer coating material ($g/m^2$) |
|---|---|---|---|---|
| I-6 | Base material I-1 | Coating material I-13 | 10 | — |
| I-7 | Base material I-1 | Coating material I-14 | 10 | — |
| I-8 | Base material I-1 | Coating material I-1 | 15 | — |
| I-9 | Base material I-1 | Coating material I-1 | 2 | — |

Test Examples

The obtained sublimation-type inkjet textile printing transfer paper was investigated for physical properties and characteristics according to the following methods. The results are shown in Table I-4.

For inkjet recording evaluation, each image for evaluation was printed in a setting mode of "plain paper+high quality") with an inkjet printer (EP704A model, manufactured by Seiko Epson Corporation) and sublimation-type textile printing ink (sublimation ink SU-110 series for EPSON, manufactured by Power System K.K.). In addition, a polyester fabric material was used as a transfer target object.

(1) Number of Pinhole Appearance I

One drop of n-hexadecane was dripped onto each of different five locations on the sublimation-type textile printing ink receiving layer by a dripping method based on an oil absorbency test method conforming to JIS P 3001 (1976) using n-hexadecane, the number of appearance of n-hexadecane traces appearing, after one minute, at each dripped location on the surface of the base material on which the sublimation-type textile printing ink receiving layer was not formed, was investigated, and the average of the numbers of appearance at the five locations was calculated.

(2) Ink Absorbability and Dryability

Immediately after solid printing in black was performed on each sublimation-type inkjet textile printing transfer paper with the inkjet printer, the printed surface was rubbed and wiped with tissue paper. At this time, presence/absence of spreading of the ink on the paper surface was visually confirmed and evaluated on the basis of the following evaluation criteria. Evaluation 3 or higher is a practical level.

(Evaluation Criteria)

5: Drying of the ink after absorption is very quick, and spreading of the ink on the paper surface is not recognized at all after wiping.

4: Drying of the ink after absorption is quick, and spreading of the ink on the paper surface is hardly recognized after wiping.

3: Drying of the ink after absorption is slightly slow, and spreading of the ink on the paper surface is slightly recognized after wiping but is not a problem in terms of practical use.

2: Drying of the ink after absorption is slow, and spreading of the ink on the paper surface is recognized after wiping.

1: Drying of the ink after absorption is very slow, fouling of the device and fouling of the printed part are recognized, spreading of the ink on the paper surface after wiping is long, and the paper cannot be used.

(3) Image Reproducibility

Image reproducibility of a digital image onto a surface of each sublimation-type inkjet textile printing transfer paper was visually observed, and evaluated on the basis of the following evaluation criteria. Evaluation 3 or higher is a practical level.

(Evaluation Criteria)

5: No difference from the original is recognized, and the image reproducibility is excellent.

4: Almost no difference from the original is recognized, and the image reproducibility is good.

3: A slight difference from the original is recognized, and the image reproducibility is slightly poor but is not a problem in terms of practical use.

2: Many differences from the original are recognized, the image reproducibility is poor, and the paper cannot be used.

1: Significant differences from the original are recognized, and almost no image reproducibility is exhibited, and the paper cannot be used.

(4) Strike-Through Prevention

Solid printing in red 100%+yellow 100% was performed with the inkjet printer on each sublimation-type inkjet textile printing transfer paper in an area of 165 mm in width×275 mm in flow direction, and thermal transfer to a fabric was performed by keeping the sublimation-type inkjet textile printing transfer paper at 190° C. for 90 seconds. Thereafter, the number of portions at which strike-through of the ink to the back surface of the transfer paper occurred and presence/absence of voids on the fabric at positions corresponding to the portions at which strike-through of the ink occurred were confirmed, and were evaluated on the basis of the following evaluation criteria. Evaluation 3 or higher is a practical level.

(Evaluation Criteria)

5: The number of portions of ink strike-through to the transfer paper back surface is 0, and no void on the fabric is recognized.

4: The number of portions of ink strike-through to the transfer paper back surface is less than 5, and no void on the fabric is recognized.

3: The number of portions of ink strike-through to the transfer paper back surface is not less than 5, but no void on the fabric is recognized.

2: The number of portions of ink strike-through to the transfer paper back surface is less than 5, but one or more voids on the fabric are recognized.

1: The number of portions of ink strike-through to the transfer paper back surface is not less than 5, and a plurality of voids on the fabric are recognized.

TABLE 4

Table I-4

| | Number of pinhole appearance I (number) | Ink absorbability and dryability | Image reproducibility | Strike-through prevention |
|---|---|---|---|---|
| Example I-1 | 5 | 3 | 3 | 3 |
| I-2 | 2 | 3 | 4 | 4 |
| I-3 | 2 | 3 | 4 | 4 |
| I-4 | 0 | 3 | 5 | 5 |
| I-5 | 2 | 3 | 4 | 4 |
| I-6 | 4 | 3 | 4 | 4 |
| I-7 | 3 | 3 | 4 | 4 |
| I-8 | 3 | 3 | 3 | 3 |
| I-9 | 1 | 3 | 3 | 4 |
| I-10 | 0 | 3 | 3 | 4 |
| I-11 | 3 | 3 | 3 | 3 |
| I-12 | 2 | 3 | 4 | 4 |
| Comparative Example I-1 | 8 | 3 | 3 | 2 |
| I-2 | 8 | 3 | 2 | 4 |
| I-3 | 6 | 3 | 2 | 2 |
| I-4 | 7 | 2 | 2 | 2 |
| I-5 | 4 | 3 | 2 | 3 |
| I-6 | 7 | 2 | 4 | 4 |
| I-7 | 10 | 3 | 3 | 2 |
| I-8 | 0 | 3 | 2 | 5 |
| I-9 | 10 | 4 | 1 | 1 |

The sublimation-type inkjet textile printing transfer paper of Examples I-1 to I-12 is sublimation-type inkjet textile printing transfer paper in which the sublimation-type textile printing ink receiving layer is formed on the base material having a 10-second Cobb water absorption of 5 to 20 g/m$^2$, the sublimation-type textile printing ink receiving layer is formed by applying the ink receiving layer coating material containing the CMC in a ratio of 100 to 400 parts by mass with respect to 100 parts by mass of the fine particles such that the coating amount after drying is 3 to 13 g/m$^2$, and inorganic fine particles that have a median diameter d50 of 0.4 to 2.3 μm and an aspect ratio of 5 to 30 and have a tabular crystal structure are used as the fine particles.

Therefore, the sublimation-type inkjet textile printing transfer paper of Examples I-1 to I-12 has excellent characteristics in that the average of the numbers of pinhole appearance I is not greater than 5 and the ink absorbability and dryability, the image reproducibility, and the strike-through prevention each can be satisfactory at a practical level.

Regarding Examples I-3 and I-4, since the under layer containing the CMC is formed between the sublimation-type textile printing ink receiving layer and the base material, although the coating amount of the ink receiving layer coating material is 3 to 4 g/m$^2$ and relatively small, the sublimation-type inkjet textile printing transfer paper has excellent characteristics equivalent to or better than those in the case of a coating amount of 10 g/m$^2$.

On the other hand, the sublimation-type inkjet textile printing transfer paper of Comparative Examples I-1 and I-2 each has a large number of pinhole appearance I, and inferior strike-through prevention (Comparative Example I-1) or inferior image reproducibility (Comparative Example I-2), since the 10-second Cobb water absorption of the base material is less than 5 g/m$^2$ (Comparative Example I-1) or exceeds 20 g/m$^2$ (Comparative Example I-2).

The sublimation-type inkjet textile printing transfer paper of Comparative Examples I-4 and I-5 each has a large number of pinhole appearance I, and inferior ink absorbability and dryability, inferior image reproducibility, and inferior strike-through prevention (Comparative Example I-4), or inferior image reproducibility (Comparative Example I-5), since the amount of the CMC with respect to 100 parts by mass of the fine particles is less than 100 parts by mass (Comparative Example I-4) or exceeds 400 parts by mass (Comparative Example I-5).

The sublimation-type inkjet textile printing transfer paper of Comparative Examples I-3 and I-6 each has a large number of pinhole appearance I, and inferior image reproducibility and inferior strike-through prevention (Comparative Example I-3), or inferior ink absorbability and dryability (Comparative Example I-6), since the median diameter d50 of the inorganic fine particles having a tabular crystal structure is less than 0.4 μm (Comparative Example I-3) or exceeds 2.3 μm (Comparative Example I-6).

The sublimation-type inkjet textile printing transfer paper of Comparative Example I-7 has a large number of pinhole appearance I and inferior strike-through prevention, since the aspect ratio of the inorganic fine particles having a tabular crystal structure is less than 5.

The sublimation-type inkjet textile printing transfer paper of Comparative Examples I-8 and I-9 each has inferior image reproducibility (Comparative Example I-8), or a large number of pinhole appearance I, inferior image reproducibility, and inferior strike-through prevention (Comparative Example I-9), since the coating amount of the ink receiving layer coating material exceeds 13 g/m$^2$ (Comparative Example I-8) or is less than 3 g/m$^2$ (Comparative Example I-9).

Example II

The components used in each production example, each preparation example, and each example, and each comparative example are as follow.

(1) Kraft Pulp

LBKP

Broad-Leaved Tree Bleached Kraft Pulp

Freeness (CSF) conforming to JIS P 8121-2: 530 ml

NBKP

Needle-Leaved Tree Bleached Kraft Pulp

Freeness (CSF) conforming to JIS P 8121-2: 580 ml (2) Water Soluble Resin A

CMC-A1

CELLOGEN 5A (manufactured by DKS Co. Ltd.)

CMC-A2

FINNFIX 2 (manufactured by CP Kelco)

PVA-A

Kuraray Poval PVA 105 (manufactured by Kuraray Co., Ltd., saponification degree: 98 to 99 mol %, polymerization degree: 500)

(3) Fine Particles A

Particle-A1

Inorganic Fine Particles Having a Tabular Crystal Structure

Secondary clay (median diameter d50: 0.7 μm, aspect ratio: 8)

Particle-A2

Inorganic Fine Particles Having a Tabular Crystal Structure

Delaminated clay (median diameter d50: 1.4 μm, aspect ratio: 20)

Particle-A3

Inorganic Fine Particles Having a Tabular Crystal Structure

Secondary clay (median diameter d50: 0.4 μm, aspect ratio: 8)

(4) Water Soluble Resin B

CMC-B1

CELLOGEN 7A (manufactured by DKS Co. Ltd.)

CMC-B2

FINNFIX 5 (manufactured by CP Kelco)

PVA-B

Kuraray Poval PVA 110 (manufactured by Kuraray Co., Ltd., saponification degree: 98 to 99 mol %, polymerization degree: 1000)

(5) Fine Particles B

Particle-B1

Synthetic Amorphous Silica Particles

CARPLEX 80 (manufactured by DSL. Japan K.K., average particle diameter: 15.0 μm)

Particle-B2

Synthetic Amorphous Silica Particles

Finesil X-37B (manufactured by OSC Japan K.K., average particle diameter: 3.7 μm)

Production Example II-1 (Production of Base Material)

Kraft paper having a basis weight of 100 g/m$^2$, a Bekk smoothness, conforming to JIS P 8119, of 100 seconds, and a 10-second Cobb water absorption, conforming to JIS P 8140, of 10 g/m$^2$ (hereinafter, referred to as base material I-1) was produced in the same manner as Production Example I-1 using LBKP, NBKP, cationized starch, an alkyl ketene dimer (internal sizing agent), and anion-modified polyacrylamide.

Production Examples II-2 to II-4 (Production of Base Material)

Kraft paper (hereinafter, referred to as base materials II-2 to II-4) was produced in the same manner as Production Example II-1, except that the amount of the alkyl ketene dimer (internal sizing agent) was adjusted such that the 10-second Cobb water absorption of the kraft paper was a value shown in Table II-1. The basis weight and the Bekk smoothness of each kraft paper are shown in Table II-1.

TABLE II-1

| Production Example | Kraft pulp (mass %) LBKP | Kraft pulp (mass %) NBKP | Basis weight (g/m$^2$) | Bekk smoothness (see) | 10-sec. Cobb water absorption (g/m$^2$) | Base material No. |
|---|---|---|---|---|---|---|
| II-1 | 85 | 15 | 100 | 100 | 10 | Base material II-1 |
| II-2 | 85 | 15 | 100 | 100 | 16 | Base material II-2 |
| II-3 | 85 | 15 | 100 | 100 | 4 | Base material II-3 |
| II-4 | 85 | 15 | 100 | 100 | 22 | Base material II-4 |

Preparation Example II-1A (Preparation of Ink Receiving Layer Coating Material A)

Particle-A1 was used as the fine particles A, and CMC-A1 was used as the water soluble resin A in an amount of 200 parts by mass with respect to 100 parts by mass of Particle-A1. CMC-A1 was added and mixed into a dispersion slurry of Particle-A1 to prepare an ink receiving layer coating material A having a solid content concentration of 18.0% (hereinafter, referred to as coating material II-A1).

Preparation Examples II-2A to II-7A (Preparation of Ink Receiving Layer Coating Material A)

Ink receiving layer coating materials A having solid content concentrations shown in Table II-2 (hereinafter, referred to as coating materials II-A2 to II-A7, respectively) were prepared in the same manner as Preparation Example II-1A, except that the composition was changed as shown in Table II-2. The amount of the fine particles A contained in each ink receiving layer coating material A is also shown in Table II-2.

In addition, the ink receiving layer coating materials A obtained in Preparation Example II-1A to II-7A were investigated for the number of pinhole appearance II. Specifically, one drop of n-hexadecane was dripped onto each of different five locations on a layer A, which was formed on the base material II-1 by applying the ink receiving layer coating material A such that the coating amount (dry) thereof was 10 g/m$^2$, by a dripping method based on an oil absorbency test method conforming to JIS P 3001 (1976) using n-hexadecane, the number of appearance of n-hexadecane traces appearing, after one minute, at each dripped location on the surface of the base material II-1 on which the layer A was not formed, was investigated, and the average of the numbers of appearance at the five locations was calculated. The results are also shown in Table II-2.

TABLE II-2

| Preparation Example | Water soluble resin A (parts by mass) CMC-A1 | CMC-A2 | PVA-A | Fine particles A (parts by mass) Particle-A1 | Particle-A2 | Particle-A3 | Solid content concentration (%) | Contained amount of fine particles A (parts by mass) | Number of pinhole appearance II (number) | Coating material |
|---|---|---|---|---|---|---|---|---|---|---|
| II-1A | 200 | — | — | 100 | — | — | 18.0 | 33 | 2 | Coating material II-A1 |
| II-2A | — | 200 | — | 100 | — | — | 18.0 | 33 | 2 | Coating material II-A2 |
| II-3A | 200 | — | 8 | 100 | — | — | 18.0 | 33 | 4 | Coating material II-A3 |
| II-4A | 100 | — | — | 100 | — | — | 18.0 | 40 | 3 | Coating material II-A4 |
| II-5A | 300 | — | — | 100 | — | — | 18.0 | 25 | 1 | Coating material II-A5 |
| II-6A | 200 | — | — | — | 100 | — | 18.0 | 33 | 0 | Coating material II-A6 |
| II-7A | 200 | — | — | — | — | 100 | 18.0 | 33 | 3 | Coating material II-A7 |

Preparation Example II-1B (Preparation of Ink Receiving Layer Coating Material B)

Particle-B1 was used as the fine particles B, and CMC-B1 was used as the water soluble resin B in an amount of 200 parts by mass with respect to 100 parts by mass of Particle-B1. CMC-B1 was added and mixed into a dispersion slurry of Particle-B1 to prepare an ink receiving layer coating material B having a solid content concentration of 16.0% (hereinafter, referred to as coating material II-B1).

Preparation Examples II-2B to II-71 (Preparation of Ink Receiving Layer Coating Material B)

Ink receiving layer coating materials B having solid content concentrations shown in Table II-3 (hereinafter, referred to as coating materials II-B2 to II-B7, respectively) were prepared in the same manner as Preparation Example II-1B, except that the composition was changed as shown in Table II-3. The amount of the fine particles B contained in each ink receiving layer coating material B is also shown in Table II-3.

Preparation Example II-1 (Preparation of Mixed Coating Material)

A mixed coating material having a solid content concentration of 17.5% (hereinafter, referred to as mixed coating material II-1) was prepared by agitating and mixing 75 parts by mass of the coating material II-A1 and 25 parts by mass of the coating material II-B1 such that a uniform composition was achieved.

Preparation Examples II-2 to II-15 (Preparation of Mixed Coating Material)

Mixed coating materials having solid content concentrations shown in Table II-4 (hereinafter, referred to as mixed coating materials II-2 to II-15, respectively) were prepared in the same manner as Preparation Example II-1, except that the composition was changed as shown in Table II-4.

TABLE II-3

| Preparation Example | Water soluble resin B (parts by mass) CMC-B1 | CMC-B2 | PVA-B | Fine particles B (parts by mass) Particle-B1 | Particle-B2 | Solid content concentration (%) | Contained amount of fine particles B (parts by mass) | Coating material |
|---|---|---|---|---|---|---|---|---|
| II-1B | 200 | — | — | 100 | — | 16.0 | 33 | Coating material II-B1 |
| II-2B | — | 200 | — | 100 | — | 16.0 | 33 | Coating material II-B2 |
| II-3B | 200 | — | 100 | 100 | — | 16.0 | 25 | Coating material II-B3 |
| II-4B | 150 | — | — | 100 | — | 16.0 | 40 | Coating material II-B4 |
| II-5B | 400 | — | — | 100 | — | 16.0 | 20 | Coating material II-B5 |
| II-6B | 200 | — | — | — | 100 | 16.0 | 33 | Coating material II-B6 |
| II-7B | 200 | — | — | 50 | 50 | 16.0 | 33 | Coating material II-B7 |

TABLE 8

Table II-4

| Preparation Example | Ink receiving layer coating material A (parts by mass) | Ink receiving layer coating material B (parts by mass) | Solid content concentration (%) | Coating material No. |
|---|---|---|---|---|
| II-1 | Coating material II-A1(75) | Coating material II-B1(25) | 17.5 | Mixed coating material II-1 |
| II-2 | Coating material II-A1(50) | Coating material II-B1(50) | 17.0 | Mixed coating material II-2 |
| II-3 | Coating material II-A1(25) | Coating material II-B1(75) | 16.5 | Mixed coating material II-3 |
| II-4 | Coating material II-A2(50) | Coating material II-B1(50) | 17.0 | Mixed coating material II-4 |
| II-5 | Coating material II-A3(50) | Coating material II-B1(50) | 17.0 | Mixed coating material II-5 |
| II-6 | Coating material II-A4(50) | Coating material II-B1(50) | 17.0 | Mixed coating material II-6 |
| II-7 | Coating material II-A5(50) | Coating material II-B1(50) | 17.0 | Mixed coating material II-7 |
| II-8 | Coating material II-A6(50) | Coating material II-B1(50) | 17.0 | Mixed coating material II-8 |
| II-9 | Coating material II-A7(50) | Coating material II-B1(50) | 17.0 | Mixed coating material II-9 |
| II-10 | Coating material II-A1(50) | Coating material II-B2(50) | 17.0 | Mixed coating material II-10 |
| II-11 | Coating material II-A1(50) | Coating material II-B3(50) | 17.0 | Mixed coating material II-11 |
| II-12 | Coating material II-A1(50) | Coating material II-B4(50) | 17.0 | Mixed coating material II-12 |
| II-13 | Coating material II-A1(50) | Coating material II-B5(50) | 17.0 | Mixed coating material II-13 |
| II-14 | Coating material II-A1(50) | Coating material II-B6(50) | 17.0 | Mixed coating material II-14 |
| II-15 | Coating material II-A1(50) | Coating material II-B7(50) | 17.0 | Mixed coating material II-15 |

Comparative Preparation Example II-1 (Preparation of Comparative Coating Material)

As the fine particles, 75 parts by mass of Particle-A1 and 25 parts by mass of Particle-B1 were used. As the water soluble resin, 150 parts by mass of CMC-A1 and 50 parts by mass of CMC-B1 were used. A dispersion slurry of Particle-A1 and a dispersion slurry of Particle-B1 were individually prepared. Thereafter, the dispersion slurry of Particle-B1 was added into the dispersion slurry of Particle-A1, and CMC-A1 and CMC-B1 were further added and mixed into the mixture to prepare a comparative coating material having a solid content concentration of 17.5% (hereinafter, referred to as comparative coating material II-1).

Comparative Preparation Example II-2 (Preparation of Comparative Coating Material)

A comparative coating material having a solid content concentration of 17.0% (hereinafter, referred to as comparative coating material II-2) was prepared in the same manner as Comparative Preparation Example II-1, except that 50 parts by mass of Particle-A1 and 50 parts by mass of Particle-B1 were used as the fine particles and 100 parts by mass of CMC-A1 and 100 parts by mass of CMC-B1 were used as the water soluble resin.

Comparative Preparation Example II-3 (Preparation of Comparative Coating Material)

A comparative coating material having a solid content concentration of 16.5% (hereinafter, referred to as comparative coating material II-3) was prepared in the same manner as Comparative Preparation Example II-1, except that 25 parts by mass of Particle-A1 and 75 parts by mass of Particle-B1 were used as the fine particles and 50 parts by mass of CMC-A1 and 150 parts by mass of CMC-B1 were used as the water soluble resin.

Example II-1 (Production of Sublimation-Type Inkjet Textile Printing Transfer Paper)

The mixed coating material II-1 was applied to one surface of the base material II-1 with an air knife coater such that the coating amount (dry) thereof was 8 g/m$^2$, and the applied mixed coating material II-1 was dried at about 130° C. to form a sublimation-type textile printing ink receiving layer, thereby producing sublimation-type inkjet textile printing transfer paper.

Examples II-2 to II-18 and Comparative Examples II-1 to II-9 (Production of Sublimation-Type Inkjet Textile Printing Transfer Paper)

Sublimation-type inkjet textile printing transfer paper was produced in the same manner as Example II-1, except that the types of the base material and the coating material and the coating amount (dry) of the coating material were changed as shown in Table II-5. In Examples II-17 and II-18 and Comparative Example II-8, an under layer coating material was applied to one surface of the base material with an air knife coater in a coating amount (dry) shown in Table II-5 and dried at about 130° C. to form an under layer, and then the mixed coating material shown in Table II-5 was applied onto the under layer. As the under layer coating material, a coating material that is the same as the ink receiving layer coating material A used in the mixed coating material was used.

TABLE 9

Table II-5

| | Type of base material | Coating material Type | Coating material Coating amount (g/m$^2$) | Coating amount of under layer coating material (g/m$^2$) |
|---|---|---|---|---|
| Example II-1 | Base material II-1 | Mixed coating material II-1 | 8 | — |
| II-2 | Base material II-1 | Mixed coating material II-2 | 8 | — |
| II-3 | Base material II-1 | Mixed coating material II-3 | 8 | — |
| II-4 | Base material II-1 | Mixed coating material II-4 | 8 | — |
| II-5 | Base material II-1 | Mixed coating material II-5 | 8 | — |
| II-6 | Base material II-1 | Mixed coating material II-6 | 8 | — |
| II-7 | Base material II-1 | Mixed coating material II-7 | 8 | — |
| II-8 | Base material II-1 | Mixed coating material II-8 | 8 | — |
| II-9 | Base material II-1 | Mixed coating material II-9 | 8 | — |
| II-10 | Base material II-1 | Mixed coating material II-10 | 8 | — |
| II-11 | Base material II-1 | Mixed coating material II-11 | 8 | — |
| II-12 | Base material II-1 | Mixed coating material II-12 | 8 | — |
| II-13 | Base material II-1 | Mixed coating material II-13 | 8 | — |
| II-14 | Base material II-1 | Mixed coating material II-14 | 8 | — |
| II-15 | Base material II-1 | Mixed coating material II-15 | 8 | — |
| II-16 | Base material II-2 | Mixed coating material II-2 | 8 | — |
| II-17 | Base material II-1 | Mixed coating material II-2 | 5 | 3 |
| II-18 | Base material II-1 | Mixed coating material II-2 | 2 | 6 |
| Comparative Example II-1 | Base material II-1 | Coating material II-A1 | 10 | — |
| II-2 | Base material II-1 | Coating material II-B1 | 8 | — |
| II-3 | Base material II-1 | Comparative coating material II-1 | 8 | — |
| II-4 | Base material II-1 | Comparative coating material II-2 | 8 | — |
| II-5 | Base material II-1 | Comparative coating material II-3 | 8 | — |
| II-6 | Base material II-3 | Mixed coating material II-2 | 8 | — |
| II-7 | Base material II-4 | Mixed coating material II-2 | 8 | — |
| II-8 | Base material II-1 | Mixed coating material II-2 | 1 | 7 |
| II-9 | Base material II-1 | Mixed coating material II-2 | 14 | — |

Test Examples

The obtained sublimation-type inkjet textile printing transfer paper was investigated for characteristics according to the following methods. The results are shown in Table II-6.

For inkjet recording evaluation, each image for evaluation was printed in a setting mode of "photographic paper+high quality") with an inkjet printer (EP704A model, manufactured by Seiko Epson Corporation) and sublimation-type textile printing ink (sublimation ink SU-110 series for EPSON, manufactured by Power System K.K.). The set print density of this mode is higher than the set print density of "plain paper+high quality" in <Example I>. In addition, a polyester fabric material was used as a transfer target object. Transfer of the image was performed by bringing a polyester fabric material and an image printed on the sublimation-type inkjet textile printing transfer paper with the inkjet printer into close contact with each other and keeping this state at 190° C. for 90 seconds thereby to perform thermal transfer.

(1) Ink Dryability

Immediately after solid printing in black was performed on each sublimation-type inkjet textile printing transfer paper with the inkjet printer, the printed surface was rubbed and wiped with tissue paper. At this time, presence/absence of spreading of the ink on the paper surface was visually confirmed and evaluated on the basis of the following evaluation criteria. Evaluation 3 or higher is a practical level.

(Evaluation Criteria)

5: Drying of the ink is very quick, and spreading of the ink on the paper surface is not recognized at all after wiping.

4: Drying of the ink is quick, and spreading of the ink on the paper surface is hardly recognized after wiping.

3: Drying of the ink is slightly slow, and spreading of the ink on the paper surface is slightly recognized after wiping but is not a problem in terms of practical use.

2: Drying of the ink is slow, and spreading of the ink on the paper surface is recognized after wiping.

1: Drying of the ink is very slow, fouling of the device and fouling of the printed part are recognized, spreading of the ink on the paper surface after wiping is long, and the paper cannot be used.

(2) Amount of Ink Remaining

Solid printing in red 100%+yellow 100% was performed with the inkjet printer on each sublimation-type inkjet textile printing transfer paper, and the sublimation-type inkjet textile printing transfer paper was kept at 190° C. for 90 seconds to perform thermal transfer onto the polyester fabric material. Thereafter, the density of the ink remaining on the sublimation-type inkjet textile printing transfer paper and the transfer density onto the fabric material were investigated, and evaluated on the basis of the following evaluation criteria. Evaluation 3 or higher is a practical level.

(Evaluation Criteria)

5: The ink slightly remains on the paper surface, and the transfer density onto the fabric material is also high.

4: The ink remains on the paper surface, but almost no influence thereof on the transfer density onto the fabric material is found.

3: The density of the ink remaining on the paper surface is slightly high, but a slight decrease in the transfer density onto the fabric material is merely felt as compared to "Evaluation 4" and is not a problem in terms of practical use.

2: The density of the ink remaining on the paper surface is high, and the transfer density onto the fabric material is also significantly decreased as compared to "Evaluation 3".

1: The density of the ink remaining on the paper surface is considerably high, and the transfer density onto the fabric material is also obviously decreased even when the fabric material is solely seen.

(3) Image Density Reproducibility

Image density reproducibility of a digital image onto a surface of each sublimation-type inkjet textile printing transfer paper was visually observed, and evaluated on the basis of the following evaluation criteria. Evaluation 3 or higher is a practical level.

(Evaluation Criteria)

5: No density difference from the original is recognized, and the image density reproducibility is excellent.

4: Almost no density difference from the original is recognized, and the image density reproducibility is good.

3: A slight density difference from the original is recognized, and the image density reproducibility is slightly poor but is not a problem in terms of practical use.

2: Many density differences from the original are recognized, the image density reproducibility is poor, and the paper cannot be used.

1: Significant density differences from the original are recognized, and almost no image density reproducibility is exhibited, and the paper cannot be used.

(4) Image Density Unevenness

Solid printing in red 100%+yellow 100% was performed with the inkjet printer on each sublimation-type inkjet textile printing transfer paper, the sublimation-type inkjet textile printing transfer paper, the polyester fabric material, and a felt base fabric were stacked in this order, cuts were made in the felt base fabric such that heat transmission was easily made ununiform, and this state was kept at 190° C. for 15 seconds to perform thermal transfer onto the fabric material. Thereafter, presence/absence of light and shade of color in a transferred image onto the fabric material at positions corresponding to the cuts in the felt base fabric was confirmed, and evaluated on the basis of the following evaluation criteria. Evaluation 3 or higher is a practical level.

(Evaluation Criteria)

5: Influence of the cuts is not found at all.

4: A lightly colored afterimage is slightly seen at the deep cut portion, but no afterimage is seen at the shallow cut portion.

3: The shape of the deep cut portion is mostly recognized, and even the shape of the shallow cut portion is slightly recognized but is not a problem in terms of practical use.

2: Not only the shape of the deep cut portion but also the shape of the shallow cut portion is recognized.

1: The cuts appear as obvious light and shade of color, and even the shape of the shallow cut portion is clearly recognized.

TABLE 10

Table II-6

| | Characteristics | | | | |
|---|---|---|---|---|---|
| | Ink dryability | Amount of ink remaining | Image density reproducibility | Image density unevenness | Sum of evaluation |
| Example II-1 | 3 | 5 | 5 | 3 | 16 |
| II-2 | 4 | 4 | 4 | 4 | 16 |
| II-3 | 5 | 3 | 3 | 5 | 16 |
| II-4 | 4 | 4 | 4 | 4 | 16 |
| II-5 | 4 | 4 | 4 | 4 | 16 |

TABLE 10-continued

Table II-6

| | Characteristics | | | | |
|---|---|---|---|---|---|
| | Ink dryability | Amount of ink remaining | Image density repro-ducibility | Image density unevenness | Sum of evalu-ation |
| II-6 | 5 | 3 | 3 | 5 | 16 |
| II-7 | 3 | 4 | 4 | 3 | 14 |
| II-8 | 3 | 5 | 5 | 3 | 16 |
| II-9 | 3 | 4 | 4 | 3 | 14 |
| II-10 | 4 | 4 | 4 | 4 | 16 |
| II-11 | 3 | 4 | 4 | 3 | 14 |
| II-12 | 4 | 4 | 4 | 4 | 16 |
| II-13 | 3 | 4 | 4 | 3 | 14 |
| II-14 | 5 | 3 | 4 | 4 | 16 |
| II-15 | 5 | 4 | 4 | 4 | 17 |
| II-16 | 3 | 4 | 4 | 4 | 15 |
| II-17 | 4 | 4 | 4 | 4 | 16 |
| II-18 | 3 | 4 | 4 | 3 | 14 |
| Comparative Example II-1 | 1 | 5 | 5 | 1 | 12 |
| II-2 | 5 | 1 | 1 | 5 | 12 |
| II-3 | 2 | 3 | 4 | 2 | 11 |
| II-4 | 3 | 2 | 3 | 3 | 11 |
| II-5 | 4 | 1 | 2 | 4 | 11 |
| II-6 | 4 | 2 | 2 | 2 | 10 |
| II-7 | 2 | 2 | 2 | 2 | 8 |
| II-8 | 1 | 1 | 1 | 3 | 6 |
| II-9 | 5 | 1 | 1 | 5 | 12 |

The sublimation-type inkjet textile printing transfer paper of Examples II-1 to II-18 is sublimation-type inkjet textile printing transfer paper in which the sublimation-type textile printing ink receiving layer is formed on the base material having a 10-second Cobb water absorption of 5 to 20 g/m$^2$, and the sublimation-type textile printing ink receiving layer is formed from the mixed coating material of: the ink receiving layer coating material A that contains the CMC, which is the water soluble resin A, and the inorganic fine particles having a tabular crystal structure, which are the fine particles A serving as a filler, in a specific ratio and that can reduce the average of the pinhole appearance II to 5 or less; and the ink receiving layer coating material B that contains the CMC, which is the water soluble resin B, and the silica particles, which are the fine particles B serving as a filler.

Therefore, the sublimation-type inkjet textile printing transfer paper of Examples II-1 to II-18 is excellent in ink dryability at the time of inkjet printing, has a small amount of ink remaining on the textile printing transfer paper at the time of transfer printing onto a transfer target object, has a high transfer density onto the transfer target object, is excellent in image density reproducibility, and has small image density unevenness. That is, the sublimation-type inkjet textile printing transfer paper of Examples II-1 to II-18 can reach the practical level in each evaluation item, and has excellent characteristics in that the total evaluation score is not less than 14.

Regarding Examples II-17 and II-18, since the under layer containing the CMC is formed between the sublimation-type textile printing ink receiving layer and the base material, although the coating amount of the mixed coating material is 5 g/m$^2$ and 2 g/m$^2$ and relatively small, the sublimation-type inkjet textile printing transfer paper has excellent characteristics equivalent to those in the case of a coating amount of 8 g/m$^2$.

On the other hand, the sublimation-type inkjet textile printing transfer paper of Comparative Example II-1 has a small amount of the ink remaining on the textile printing transfer paper and a high transfer density onto the transfer target object, but has very inferior ink dryability, since the sublimation-type textile printing ink receiving layer is formed from only the ink receiving layer coating material A. In addition, the sublimation-type inkjet textile printing transfer paper of Comparative Example II-1 has excellent image density reproducibility but has very large image density unevenness.

The sublimation-type inkjet textile printing transfer paper of Comparative Example II-2 has excellent ink dryability, but has a very large amount of the ink remaining on the textile printing transfer paper and a very low transfer density onto the transfer target object, since the sublimation-type textile printing ink receiving layer is formed from only the ink receiving layer coating material B. In addition, the sublimation-type inkjet textile printing transfer paper of Comparative Example II-2 has small image density unevenness but has very inferior image density reproducibility.

The sublimation-type inkjet textile printing transfer paper of Comparative Examples II-3 to II-5 each has inferior ink dryability and large image density unevenness (Comparative Example II-3), or a large amount of the ink remaining and a low transfer density onto the transfer target object (Comparative Example II-4), or a very large amount of the ink remaining, a very low transfer density onto the transfer target object, and inferior image density reproducibility (Comparative Example II-5), since the sublimation-type textile printing ink receiving layer is formed from the coating material prepared by mixing the water soluble resin after mixing of the slurries of two types of fine particles, not from a mixed coating material obtained by mixing two types of coating materials prepared separately.

The sublimation-type inkjet textile printing transfer paper of Comparative Examples II-6 and II-7 each has a large amount of the ink remaining, a low transfer density onto the transfer target object, inferior image density reproducibility, and large image density unevenness (Comparative Example II-6), or inferior ink dryability, a large amount of the ink remaining, a low transfer density onto the transfer target object, inferior image density reproducibility, and large image density unevenness (Comparative Example II-7), since the 10-second Cobb water absorption of the base material is less than 5 g/m$^2$ (Comparative Example II-6) or exceeds 20 g/m$^2$ (Comparative Example II-7).

The sublimation-type inkjet textile printing transfer paper of Comparative Examples II-8 and II-9 each has very inferior ink dryability, a very large amount of the ink remaining, a very low transfer density onto the transfer target object, and very inferior image density reproducibility (Comparative Example II-8), or a very large amount of the ink remaining, a very low transfer density onto the transfer target object, and very inferior image density reproducibility (Comparative Example II-9), since the coating amount of the ink receiving layer coating material is less than 2 g/m$^2$ (Comparative Example II-8) or exceeds 12 g/m$^2$ (Comparative Example II-9).

Example III

The components used in each production example, each preparation example, and each example, and each comparative example are as follow.

(1) Kraft Pulp

LBKP

Broad-Leaved Tree Bleached Kraft Pulp

Freeness (CSF) conforming to JIS P 8121-2: 530 ml

NBKP

Needle-Leaved Tree Bleached Kraft Pulp
Freeness (CSF) conforming to JIS P 8121-2: 580 ml
(2) Water Soluble Resin
CMC-A1
CELLOGEN 5A (manufactured by DKS Co. Ltd.)
PVA-A
Kuraray Poval PVA 105 (manufactured by Kuraray Co., Ltd., saponification degree: 98 to 99 mol %, polymerization degree: 500)
(3) Fine Particles A
Particle-A1
Inorganic Fine Particles Having a Tabular Crystal Structure
Secondary clay (median diameter d50: 0.7 μm, aspect ratio: 8)
(5) Fine Particles B
Particle-B1
Synthetic Amorphous Silica Particles
CARPLEX 80 (manufactured by DSL. Japan K.K., average particle diameter: 15.0 nm)
Particle-B2
Synthetic Amorphous Silica Particles
Finesil X-37B (manufactured by OSC Japan K.K., average particle diameter: 3.7 μm)

Production Example III-1 (Production of Base Material)

Kraft paper having a basis weight of 100 g/m$^2$, a Bekk smoothness, conforming to JIS P 8119, of 100 seconds, and a 10-second Cobb water absorption, conforming to JIS P 8140, of 10 g/m$^2$ (hereinafter, referred to as base material III-1) was produced in the same manner as Production Example I-1 using LBKP, NBKP, cationized starch, an alkyl ketene dimer (internal sizing agent), and anion-modified polyacrylamide.

Production Examples III-2 to III-4 (Production of Base Material)

Kraft paper (hereinafter, referred to as base materials III-2 to III-4) was produced in the same manner as Production Example III-1, except that the amount of the alkyl ketene dimer (internal sizing agent) was adjusted such that the 10-second Cobb water absorption of the kraft paper was a value shown in Table III-1. The basis weight and the Bekk smoothness of each kraft paper are shown in Table HIT-1.

TABLE III-1

| Production | Kraft pulp (mass %) | | Basis weight | Bekk smoothness | 10-sec Cobb water absorption | Base material |
|---|---|---|---|---|---|---|
| Example | LBKP | NBKP | (g/m$^2$) | (sec) | (g/m$^2$) | No. |
| III-1 | 85 | 15 | 100 | 100 | 10 | Base material III-1 |
| III-2 | 85 | 15 | 100 | 100 | 16 | Base material III-2 |
| III-3 | 85 | 15 | 100 | 100 | 4 | Base material III-3 |
| III-4 | 85 | 15 | 100 | 100 | 22 | Base material III-4 |

Preparation Example III-1 (Preparation of Ink Receiving Layer Coating Material)

CMC-A1 was used as the water soluble resin, Particle-A1 was used as the fine particles A, Particle-B1 was used as the fine particles B, and water was used as a solvent. The ratio of the water soluble resin (solid content), the fine particles A, and the fine particles B (water soluble resin:fine particles A:fine particles B) is 200:75:25 as a mass ratio.

First, the ratio of Particle-A1l was adjusted to 70 parts by mass with respect to 30 parts by mass of water, and Particle-A1 was added and dispersed in water to obtain a 70% high-density dispersion. Next, 44.5 parts by mass of water was added to 45.0 parts by mass of the high-density dispersion to prepare a diluted dispersion, and 10.5 parts by mass of Particle-B1 was immediately added and dispersed in the diluted dispersion to prepare a mixed dispersion slurry. In the obtained mixed dispersion slurry, the concentration of Particle-A1 was 31.5%, the concentration of Particle-B1 was 10.5%, and the mixed concentration of both particles was 42.0%.

Next, CMC-A1 was added and mixed into the mixed dispersion slurry to prepare an ink receiving layer coating material having a solid content concentration of 17.5% (hereinafter, referred to as coating material III-1).

Preparation Examples III-2 to III-6 (Preparation of Ink Receiving Layer Coating Material)

Ink receiving layer coating materials having solid content concentrations shown in Table III-3 (hereinafter, referred to as coating materials III-2 to III-6, respectively) were prepared in the same manner as Preparation Example III-1, except the composition and the addition ratio of each component were as shown in Table III-2.

TABLE III-2

| Preparation Example | Composition of coating material (parts by mass) | | | High-density dispersion Composition (parts by mass) | | | Composition of diluted dispersion and added amount of fine particles B (parts by mass) Diluted dispersion | | |
|---|---|---|---|---|---|---|---|---|---|
| | CMC-A1 | Particle-A1 | Particle-B1 | Water | Particle-A1 | Concentration (%) | High-density dispersion | Water | Particle-B |
| III-1 | 200 | 75 | 25 | 30 | 70 | 70 | 45.0 | 44.5 | 10.5 |
| III-2 | 200 | 50 | 50 | 30 | 70 | 70 | 21.4 | 63.6 | 15.0 |
| III-3 | 200 | 25 | 75 | 30 | 70 | 70 | 8.6 | 73.4 | 18.0 |
| III-4 | 100 | 50 | 50 | 30 | 70 | 70 | 21.4 | 63.6 | 15.0 |
| III-5 | 150 | 50 | 50 | 30 | 70 | 70 | 21.4 | 63.6 | 15.0 |
| III-6 | 350 | 50 | 50 | 30 | 70 | 70 | 21.4 | 63.6 | 15.0 |

TABLE 13

Table III-3

| Preparation Example | Concentrations of respective components in mixed dispersion slurry (%) | | | Solid content concentration of coating material (%) | Coating material No. |
|---|---|---|---|---|---|
| | Particle A1 | Particle B1 | Mixture | | |
| III-1 | 31.5 | 10.5 | 42.0 | 17.5 | Coating material III-1 |
| III-2 | 15.0 | 15.0 | 30.0 | 17.0 | Coating material III-2 |
| III-3 | 6.0 | 18.0 | 24.0 | 16.5 | Coating material III-3 |
| III-4 | 15.0 | 15.0 | 30.0 | 17.5 | Coating material III-4 |
| III-5 | 15.0 | 15.0 | 30.0 | 17.0 | Coating material III-5 |
| III-6 | 15.0 | 15.0 | 30.0 | 16.5 | Coating material III-6 |

Comparative Preparation Example III-1 (Preparation of Comparative Coating Material)

CMC-A1 was used as the water soluble resin, Particle-A1 was used as the fine particles A, and water was used as a solvent. The ratio of the water soluble resin (solid content) and the fine particles A (water soluble resin:fine particles A) is 200:100 as a mass ratio.

First, a diluted dispersion that is a dispersion slurry of the fine particles A was prepared in the same manner as Preparation Example III-1. Next, CMC-A1 was added and mixed into the dispersion slurry to prepare a comparative coating material having a solid content concentration of 18.0% (hereinafter, referred to as comparative coating material III-1).

Comparative Preparation Examples III-2 and III-3 (Preparation of Comparative Coating Material)

Comparative coating materials having solid content concentrations shown in Table II-5 (hereinafter, referred to as comparative coating materials III-2 and III-3, respectively) were prepared in the same manner as Comparative Preparation Example III-1, except that the composition was changed as shown in Table III-4.

Comparative Preparation Example III-4 (Preparation of Comparative Coating Material)

CMC-A1 was used as the water soluble resin, Particle-B1 was used as the fine particles B, and water was used as a solvent. The ratio of the water soluble resin (solid content) and the fine particles B (water soluble resin:fine particles B) is 200:100 as a mass ratio.

First, a diluted dispersion that is a dispersion slurry of the fine particles B was prepared in the same manner as Comparative Preparation Example ITT-1, except that the fine particles B were used instead of the fine particles A. Next, CMC-A1 was added and mixed into the dispersion slurry to prepare a comparative coating material having a solid content concentration of 16.0% (hereinafter, referred to as comparative coating material III-4).

Comparative Preparation Examples III-5 to III-8 (Preparation of Comparative Coating Material)

Comparative coating materials having solid content concentrations shown in Table II-5 (hereinafter, referred to as comparative coating materials III-5 to III-8, respectively) were prepared in the same manner as Comparative Preparation Example III-4, except that the composition was changed as shown in Table III-4.

In Comparative Preparation Examples III-5 and III-6, PVA-A was added to the dispersion slurry earlier than CMC-A1 to prepare a comparative coating material.

Comparative Preparation Examples III-9 to III-12 (Preparation of Comparative Coating Material)

Comparative coating materials having solid content concentrations shown in Table III-5 (hereinafter, referred to as comparative coating materials III-9 to III-12, respectively) were prepared in the same manner as Preparation Example III-1, except that the composition and the addition ratio of each component were changed as shown in Table III-4.

TABLE III-4

| Comparative Preparation Example | Composition of coating material (parts by mass) | | | | | High-density dispersion Composition (parts by mass) | | | Composition of diluted dispersion and added amount of fine particles B (parts by mass) Diluted dispersion | | |
|---|---|---|---|---|---|---|---|---|---|---|---|
| | CMC-A1 | PVA-A | Particle A1 | Particle B1 | Particle B2 | Water | Particle-A1 | Concentration (%) | High-density dispersion | Water | Particle-B |
| III-1 | 200 | — | 100 | — | — | — | — | — | — | — | — |
| III-2 | 80 | — | 100 | — | — | — | — | — | — | — | — |
| III-3 | 40 | — | 100 | — | — | — | — | — | — | — | — |
| III-4 | 200 | — | — | 100 | — | — | — | — | — | — | — |
| III-5 | 200 | 25 | — | 100 | — | — | — | — | — | — | — |
| III-6 | 500 | 25 | — | — | 100 | — | — | — | — | — | — |
| III-7 | 150 | — | — | 100 | — | — | — | — | — | — | — |
| III-8 | 100 | — | — | 100 | — | — | — | — | — | — | — |
| III-9 | 200 | — | 90 | 10 | — | 30 | 70 | 70 | 71.4 | 23.0 | 5.6 |
| III-10 | 200 | — | 10 | 90 | — | 30 | 70 | 70 | 3.2 | 76.8 | 20.0 |
| III-11 | 450 | — | 50 | 50 | — | 30 | 70 | 70 | 21.4 | 63.6 | 15.0 |
| III-12 | 75 | — | 50 | 50 | — | 30 | 70 | 70 | 21.4 | 63.6 | 15.0 |

TABLE 15

Table III-5

| Comparative Preparation Example | Concentrations of respective components in mixed dispersion slurry (%) | | | Solid content concentration of coating material (%) | Coating material No. |
|---|---|---|---|---|---|
| | Particle-A1 | Particle-B1 | Mixture | | |
| III-1 | — | — | — | 18.0 | Comparative coating material III-1 |
| III-2 | — | — | — | 18.0 | Comparative coating material III-2 |
| III-3 | — | — | — | 18.0 | Comparative coating material III-3 |
| III-4 | — | — | — | 16.0 | Comparative coating material III-4 |
| III-5 | — | — | — | 16.0 | Comparative coating material III-5 |
| III-6 | — | — | — | 16.0 | Comparative coating material III-6 |
| III-7 | — | — | — | 16.0 | Comparative coating material III-7 |
| III-8 | — | — | — | 16.0 | Comparative coating material III-8 |
| III-9 | 50.0 | 5.6 | 55.6 | 18.0 | Comparative coating material III-9 |

TABLE 15-continued

Table III-5

| Comparative Preparation Example | Concentrations of respective components in mixed dispersion slurry (%) Particle-A1 | Particle-B1 | Mixture | Solid content concentration of coating material (%) | Coating material No. |
|---|---|---|---|---|---|
| III-10 | 2.2 | 20.0 | 22.2 | 16.0 | Comparative coating material III-10 |
| III-11 | 15.0 | 15.0 | 30.0 | 16.5 | Comparative coating material III-11 |
| III-12 | 15.0 | 15.0 | 30.0 | 17.5 | Comparative coating material III-12 |

Example III-1 (Production of Sublimation-Type Inkjet Textile Printing Transfer Paper)

The coating material III-1 was applied to one surface of the base material III-1 with an air knife coater such that the coating amount (dry) thereof was 8 g/m$^2$, and the applied coating material III-1 was dried at about 130° C. to form a sublimation-type textile printing ink receiving layer, thereby producing sublimation-type inkjet textile printing transfer paper.

Examples III-2 to III-6 and Comparative Examples III-1 to III-14 (Production of Sublimation-Type Inkjet Textile Printing Transfer Paper)

Sublimation-type inkjet textile printing transfer paper was produced in the same manner as Example III-1, except that the types of the base material and the coating material were changed as shown in Table III-6.

TABLE 16

Table III-6

| | Type of base material | Coating material Type | Coating amount (g/m$^2$) |
|---|---|---|---|
| Example III-1 | Base material III-1 | Coating material III-1 | 8 |
| III-2 | Base material III-1 | Coating material III-2 | 8 |
| III-3 | Base material III-1 | Coating material III-3 | 8 |
| III-4 | Base material III-1 | Coating material III-4 | 8 |
| III-5 | Base material III-1 | Coating material III-5 | 8 |
| III-6 | Base material III-2 | Coating material III-6 | 8 |
| Comparative Example III-1 | Base material III-1 | Comparative coating material III-1 | 8 |
| III-2 | Base material III-1 | Comparative coating material III-2 | 8 |
| III-3 | Base material III-1 | Comparative coating material III-3 | 8 |
| III-4 | Base material III-1 | Comparative coating material III-4 | 8 |
| III-5 | Base material III-1 | Comparative coating material III-5 | 8 |
| III-6 | Base material III-1 | Comparative coating material III-6 | 8 |
| III-7 | Base material III-1 | Comparative coating material III-7 | 8 |
| III-8 | Base material III-1 | Comparative coating material III-8 | 8 |
| II1-9 | Base material III-1 | Comparative coating material III-9 | 8 |
| III-10 | Base material III-1 | Comparative coating material III-10 | 8 |
| III-11 | Base material III-1 | Comparative coating material III-11 | 8 |
| III-12 | Base material III-1 | Comparative coating material III-12 | 8 |
| III-13 | Base material III-3 | Coating material III-2 | 8 |
| III-14 | Base material III-4 | Coating material III-2 | 8 |

Test Examples

The obtained sublimation-type inkjet textile printing transfer paper was investigated for characteristics according to the following methods. The results are shown in Table III-7.

For inkjet recording evaluation, each image for evaluation was printed in a setting mode of "photographic paper+high quality") with an inkjet printer (EP704A model, manufactured by Seiko Epson Corporation) and sublimation-type textile printing ink (sublimation ink SU-110 series for EPSON, manufactured by Power System K.K.). The set print density of this mode is higher than the set print density of "plain paper+high quality" in <Example I>. In addition, a polyester fabric material was used as a transfer target object. Transfer of the image was performed by bringing polyester fabric material and an image printed on the sublimation-type inkjet textile printing transfer paper with the inkjet printer into close contact with each other and keeping this state at 190° C. for 90 seconds thereby to perform thermal transfer.

(1) Ink Dryability

Immediately after solid printing in black was performed on each sublimation-type inkjet textile printing transfer paper with the inkjet printer, the printed surface was rubbed and wiped with tissue paper. At this time, presence/absence of spreading of the ink on the paper surface was visually confirmed and evaluated on the basis of the following evaluation criteria. Evaluation 3 or higher is a practical level.

(Evaluation Criteria)

5: Drying of the ink is very quick, and spreading of the ink on the paper surface is not recognized at all after wiping.

4: Drying of the ink is quick, and spreading of the ink on the paper surface is hardly recognized after wiping.

3: Drying of the ink is slightly slow, and spreading of the ink on the paper surface is slightly recognized after wiping but is not a problem in terms of practical use.

2: Drying of the ink is slow, and spreading of the ink on the paper surface is recognized after wiping.

1: Drying of the ink is very slow, fouling of the device and fouling of the printed part are recognized, spreading of the ink on the paper surface after wiping is long, and the paper cannot be used.

(2) Amount of Ink Remaining

Solid printing in red 100%+yellow 100% was performed with the inkjet printer on each sublimation-type inkjet textile printing transfer paper, and the sublimation-type inkjet textile printing transfer paper was kept at 190° C. for 90 seconds to perform thermal transfer onto the polyester fabric material. Thereafter, the density of the ink remaining on the sublimation-type inkjet textile printing transfer paper and the transfer density onto the fabric material were investigated, and evaluated on the basis of the following evaluation criteria. Evaluation 3 or higher is a practical level.

(Evaluation Criteria)

5: The ink slightly remains on the paper surface, and the transfer density onto the fabric material is also high.

4: The ink remains on the paper surface, but almost no influence thereof on the transfer density onto the fabric material is found.

3: The density of the ink remaining on the paper surface is slightly high, but a slight decrease in the transfer density onto the fabric material is merely felt as compared to "Evaluation 4" and is not a problem in terms of practical use.

2: The density of the ink remaining on the paper surface is high, and the transfer density onto the fabric material is also significantly decreased as compared to "Evaluation 3".

1: The density of the ink remaining on the paper surface is considerably high, and the transfer density onto the fabric material is also obviously decreased even when the fabric material is solely seen.

(3) Image Density Reproducibility

Image density reproducibility of a digital image onto a surface of each sublimation-type inkjet textile printing transfer paper was visually observed, and evaluated on the basis of the following evaluation criteria. Evaluation 3 or higher is a practical level.

(Evaluation criteria)

5: No density difference from the original is recognized, and the image density reproducibility is excellent.

4: Almost no density difference from the original is recognized, and the image density reproducibility is good.

3: A slight density difference from the original is recognized, and the image density reproducibility is slightly poor but is not a problem in terms of practical use.

2: Many density differences from the original are recognized, the image density reproducibility is poor, and the paper cannot be used.

1: Significant density differences from the original are recognized, and almost no image density reproducibility is exhibited, and the paper cannot be used.

(4) Image Density Unevenness

Solid printing in red 100%+yellow 100% was performed with the inkjet printer on each sublimation-type inkjet textile printing transfer paper, the sublimation-type inkjet textile printing transfer paper, the polyester fabric material, and a felt base fabric were stacked in this order, cuts were made in the felt base fabric such that heat transmission was easily made ununiform, and this state was kept at 190° C. for 15 seconds to perform thermal transfer onto the fabric material. Thereafter, presence/absence of light and shade of color in a transferred image onto the fabric material at positions corresponding to the cuts in the felt base fabric was confirmed, and evaluated on the basis of the following evaluation criteria. Evaluation 3 or higher is a practical level.

(Evaluation Criteria)

5: Influence of the cuts is not found at all.

4: A lightly colored afterimage is slightly seen at the deep cut portion, but no afterimage is seen at the shallow cut portion.

3: The shape of the deep cut portion is mostly recognized, and even the shape of the shallow cut portion is slightly recognized but is not a problem in terms of practical use.

2: Not only the shape of the deep cut portion but also the shape of the shallow cut portion is recognized.

1: The cuts appear as obvious light and shade of color, and even the shape of the shallow cut portion is clearly recognized.

(5) Powder Falling

A commercially available cellophane adhesive tape (No. 405, manufactured by Nichiban Co., Ltd.) that has a width of about 15 mm and is transparent so that adhesion of powder is easily recognized was pressed and adhered to the surface of the sublimation-type textile printing ink receiving layer of each sublimation-type inkjet textile printing transfer paper over a length of about 5 cm by reciprocating a 2 kg roller thereon once. Thereafter, the cellophane adhesive tape was peeled off at a speed at which the transfer paper was not torn. The adhesive surface of the peeled cellophane adhesive tape was visually observed, whether powder of the coating material adhered to the adhesive surface was investigated, and powder falling was evaluated on the basis of the following evaluation criteria. Evaluation "good" is a practical level.

(Evaluation criteria)

Good: No powder falling is recognized.

Poor: Powder falling is recognized even slightly.

(6) Integrated Evaluation

Integrated evaluation was made on the basis of the following evaluation criteria.

(Evaluation criteria)

○: In all the above (1) to (5), the practical level is achieved.

x: In at least one of the above (1) to (5), the practical level is not achieved.

TABLE III-7

| | Characteristics | | | | | |
|---|---|---|---|---|---|---|
| | Ink dryability | Amount of ink remaining | Image density reproducibility | Image density unevenness | Powder falling | Total evaluation |
| Example | | | | | | |
| III-1 | 3 | 4 | 4 | 3 | Good | ○ |
| III-2 | 4 | 4 | 4 | 3 | Good | ○ |
| III-3 | 4 | 3 | 3 | 3 | Good | ○ |
| III-4 | 4 | 3 | 3 | 3 | Good | ○ |
| III-5 | 4 | 3 | 3 | 3 | Good | ○ |
| III-6 | 3 | 4 | 3 | 3 | Good | ○ |
| Comparative Example | | | | | | |
| III-1 | 2 | 4 | 4 | 2 | Good | x |
| III-2 | 2 | 4 | 4 | 2 | Good | x |
| III-3 | 1 | 4 | 4 | 2 | Poor | x |
| III-4 | 4 | 2 | 2 | 3 | Good | x |
| III-5 | 3 | 2 | 2 | 3 | Good | x |
| III-6 | 2 | 2 | 2 | 3 | Good | x |
| III-7 | 4 | 2 | 2 | 4 | Good | x |
| III-8 | 5 | 2 | 2 | 4 | Poor | x |
| III-9 | 2 | 4 | 4 | 2 | Good | x |
| III-10 | 4 | 2 | 2 | 4 | Good | x |
| III-11 | 2 | 3 | 3 | 2 | Good | x |
| III-12 | 4 | 3 | 3 | 4 | Poor | x |
| III-13 | 4 | 2 | 2 | 2 | Good | x |
| III-14 | 2 | 2 | 2 | 2 | Good | x |

The sublimation-type inkjet textile printing transfer paper of Examples III-1 to III-6 is sublimation-type inkjet textile printing transfer paper in which the sublimation-type textile printing ink receiving layer is formed on the base material having a 10-second Cobb water absorption of 5 to 20 g/m$^2$, and the sublimation-type textile printing ink receiving layer is formed from the ink receiving layer coating material that contains the CMC, which is the water soluble resin, and the inorganic fine particles having a tabular crystal structure, which are a filler, and the silica particles, which are a filler, in a specific ratio.

Therefore, the sublimation-type inkjet textile printing transfer paper of Examples III-1 to III-6 is excellent in ink dryability at the time of inkjet printing, has no powder falling from the paper surface, also has a small amount of ink remaining on the textile printing transfer paper at the time of transfer printing onto a transfer target object, has a high transfer density onto the transfer target object, is excellent in image density reproducibility, and has small image density unevenness. That is, the sublimation-type inkjet textile printing transfer paper of Examples III-1 to III-6 can reach the practical level in each evaluation item, and has excellent characteristics.

On the other hand, the sublimation-type inkjet textile printing transfer paper of Comparative Examples III-1 to III-3 has inferior ink dryability and large image density unevenness, since the sublimation-type textile printing ink receiving layer is formed from the ink receiving layer coating material in which the fine particles B are not blended. In addition, regarding the sublimation-type inkjet textile printing transfer paper of Comparative Example III-3, powder falling from the paper surface is also recognized, since the sublimation-type textile printing ink receiving layer is formed from the ink receiving layer coating material in which the blending amount of the CMC with respect to the fine particles A is small.

The sublimation-type inkjet textile printing transfer paper of Comparative Examples III-4 to III-8 has a large amount of the ink remaining on the textile printing transfer paper, a low transfer density onto the transfer target object, and inferior image density reproducibility, since the sublimation-type textile printing ink receiving layer is formed from the ink receiving layer coating material in which the fine particles A are not blended. In addition, the sublimation-type inkjet textile printing transfer paper of Comparative Example III-6 has inferior ink dryability, since the sublimation-type textile printing ink receiving layer is formed from the ink receiving layer coating material in which the amount of the CMC with respect to the fine particles B is large. Furthermore, regarding the sublimation-type inkjet textile printing transfer paper of Comparative Example III-8, powder falling from the paper surface is also recognized, since the sublimation-type textile printing ink receiving layer is formed from the ink receiving layer coating material in which the amount of the CMC with respect to the fine particles B is small.

The sublimation-type inkjet textile printing transfer paper of Comparative Examples III-9 and III-10 each has inferior ink dryability and large image density unevenness (Comparative Example III-9), or a large amount of the ink remaining on the textile printing transfer paper, a low transfer density onto the transfer target object, and inferior image density reproducibility (Comparative Example III-10), since the sublimation-type textile printing ink receiving layer is formed from the ink receiving layer coating material in which the ratio of the fine particles A and the fine particles B (fine particles A/fine particles B) exceeds 85/15 (Comparative Example III-9) or is less than 15/85 (Comparative Example III-10).

The sublimation-type inkjet textile printing transfer paper of Comparative Example III-11 has inferior ink dryability and large image density unevenness, since the sublimation-type textile printing ink receiving layer is formed form the ink receiving layer coating material in which the amount of the CMC exceeds 400 parts by mass with respect to the 100 parts by mass in total of the fine particles A and the fine particles B.

Regarding the sublimation-type inkjet textile printing transfer paper of Comparative Example III-12, powder falling from the paper surface is recognized, since the sublimation-type textile printing ink receiving layer is formed form the ink receiving layer coating material in which the amount of the CMC is less than the sum of 50 parts by mass with respect to 100 parts by mass of the fine particles A and 120 parts by mass with respect to 100 parts by mass of the fine particles B.

The sublimation-type inkjet textile printing transfer paper of Comparative Examples III-13 and III-14 each has a large amount of the ink remaining, a low transfer density onto the transfer target object, inferior image density reproducibility, and large image density unevenness (Comparative Example III-13), or inferior ink dryability, a large amount of the ink remaining, a low transfer density onto the transfer target object, inferior image density reproducibility, and large image density unevenness (Comparative Example III-14), since the 10-second Cobb water absorption of the base material is less than 5 g/m$^2$ (Comparative Example III-13) or exceeds 20 g/m$^2$ (Comparative Example III-14).

As presented above, the embodiments have been described as an example of the technology according to the present disclosure. For this purpose, the accompanying drawings and the detailed description are provided.

Therefore, components in the detail description may include not only components essential for solving problems, but also components that are provided to illustrate the above described technology and are not essential for solving problems. Therefore, such inessential components should not be readily construed as being essential based on the fact that such inessential components are mentioned in the detailed description.

Further, the above described embodiments have been described to exemplify the technology according to the present disclosure, and therefore, various modifications, replacements, additions, and omissions may be made within the scope of the claims and the scope of the equivalents thereof.

INDUSTRIAL APPLICABILITY

The sublimation-type inkjet textile printing transfer paper according to the present disclosure is particularly suitable for, for example, an inkjet recording method in which printing is performed by an inkjet printer using sublimation-type textile printing ink.

The invention claimed is:

1. Sublimation-type inkjet textile printing transfer paper comprising a base material and a sublimation-type textile printing ink receiving layer formed on the base material, wherein the base material has a 10-second Cobb water absorption, conforming to JIS P 8140, of 5 to 20 g/m$^2$, the sublimation-type textile printing ink receiving layer is made from an ink receiving layer coating material containing a water soluble resin and fine particles, the water soluble resin is at least a sodium carboxymethyl cellulose, and the sodium carboxymethyl cellulose is contained in the ink receiving layer coating material in a ratio of 100 to 400 parts by mass with respect to 100 parts by mass of the fine particles, the fine particles are at least inorganic fine particles having a tabular crystal structure, the inorganic fine particles having the tabular crystal structure have a median diameter d50 in a range of 0.4 to 2.3 μm and have an aspect ratio of 5 to 30, a coating amount (dry) of the ink receiving layer coating material is 3 to 13 g/m$^2$, a back surface of the base material is not coated by the sublimation-type textile printing ink receiving layer, and an average number of n-hexadecane traces at five portions is not greater than 5, the n-hexadecane traces appearing on the back surface of the base material 1 minute after one drop of n-hexadecane is dripped to each of the five portions on the sublimation-type textile printing ink receiving layer by using a dripping method based on an oil absorbency test method conforming to JIS P 3001 (1976) using n-hexadecane.

2. The sublimation-type inkjet textile printing transfer paper according to claim 1, wherein an under layer is formed between the sublimation-type textile printing ink receiving layer and the base material, and the under layer contains a sodium carboxymethyl cellulose.

3. Sublimation-type inkjet textile printing transfer paper comprising a base material and a sublimation-type textile printing ink receiving layer formed on the base material, wherein the base material has a 10-second Cobb water absorption, conforming to JIS P 8140, of 5 to 20 g/m$^2$, the sublimation-type textile printing ink receiving layer is made from a mixed coating material of an ink receiving layer coating material A containing a water soluble resin A and fine particles A and an ink receiving layer coating material B containing a water soluble resin B and fine particles B, in the ink receiving layer coating material A, the water soluble resin A is at least a sodium carboxymethyl cellulose, and the sodium carboxymethyl cellulose is contained in the ink receiving layer coating material A in a ratio of 100 to 400 parts by mass with respect to 100 parts by mass of the fine particles A, the fine particles A are at least inorganic fine particles having a tabular crystal structure, and the inorganic fine particles having the tabular crystal structure have a median diameter d50 in a range of 0.4 to 2.3 μm and have an aspect ratio of 5 to 30, in the case where a layer A is formed on a surface of the base material from the ink receiving layer coating material A and a back surface of the base material is not coated by the layer A, an average number of n-hexadecane traces at five portions is not greater than 5, the n-hexadecane traces appearing on the back surface of the base material 1 minute after one drop of n-hexadecane is dripped to each of the five portions on the layer A by using a dripping method based on an oil absorbency test method conforming to JIS P 3001 (1976) using n-hexadecane, in the ink receiving layer coating material B, the water soluble resin B is at least a sodium carboxymethyl cellulose, and the fine particles B are at least silica particles, and a coating amount (dry) of the mixed coating material is 2 to 12 g/m$^2$.

4. The sublimation-type inkjet textile printing transfer paper according to claim 3, wherein the sodium carboxymethyl cellulose is contained in the ink receiving layer coating material B in a ratio of 100 to 500 parts by mass with respect to 100 parts by mass of the fine particles B.

5. The sublimation-type inkjet textile printing transfer paper according to claim 3, wherein a ratio of the ink receiving layer coating material A and the ink receiving layer coating material B in the mixed coating material (ink receiving layer coating material A/ink receiving layer coating material B) is 20/80 to 80/20 as a solid content mass ratio.

6. A production method for the sublimation-type inkjet textile printing transfer paper according to claim 3, the production method comprising the steps of:

preparing the ink receiving layer coating material A from at least the water soluble resin A and the fine particles A;

preparing the ink receiving layer coating material B from at least the water soluble resin B and the fine particles B;

mixing the ink receiving layer coating material A and the ink receiving layer coating material B to prepare the mixed coating material; and applying the mixed coating material onto the base material to form the sublimation-type textile printing ink receiving layer on the base material.

7. The production method according to claim 6, wherein the mixed coating material is prepared by mixing the ink receiving layer coating material A and the ink receiving layer coating material B in a ratio of 20/80 to 80/20 (ink receiving layer coating material A/ink receiving layer coating material B) as a solid content mass ratio.

8. Sublimation-type inkjet textile printing transfer paper comprising a base material and a sublimation-type textile printing ink receiving layer formed on the base material, wherein the base material has a 10-second Cobb water absorption, conforming to JIS P 8140, of 5 to 20 g/m$^2$, the sublimation-type textile printing ink receiving layer is made from an ink receiving layer coating material containing at least a water soluble resin, fine particles A, and fine particles B, the water soluble resin is at least a sodium carboxymethyl cellulose, the fine particles A are at least inorganic fine particles having a tabular crystal structure, and the inorganic fine particles having the tabular crystal structure have a median diameter d50 in a range of 0.4 to 2.3 μm and have an aspect ratio of not less than 5, the fine particles B are at least silica particles, a ratio of the fine particles A and the fine particles B (fine particles A/fine particles B) is 15/85 to 90/10 as a mass ratio, an amount of the sodium carboxymethyl cellulose in solid content is not less than the sum of 50 parts by mass with respect to 100 parts by mass of the fine particles A and 120 parts by mass with respect to 100 parts by mass of the fine particles B and not greater than 400 parts by mass with respect to 100 parts by mass in total of the fine particles A and fine particles B, and a coating amount (dry) of the ink receiving layer coating material is 2 to 12 g/m$^2$.

9. A production method for the sublimation-type inkjet textile printing transfer paper according to claim 8, the production method comprising the steps of:

preparing a high-density dispersion of the fine particles A, then adding a solvent to the high-density dispersion in a predetermined ratio to dilute the high-density dispersion, and immediately adding and dispersing the fine particles B in an obtained diluted dispersion, to prepare a mixed dispersion slurry of the fine particles A and the fine particles B;

adding and mixing the water soluble resin into the mixed dispersion slurry to prepare the ink receiving layer coating material; and applying the ink receiving layer coating material onto the base material to form the sublimation-type textile printing ink receiving layer on the base material.

* * * * *